US012378863B1

(12) United States Patent
Yang et al.

(10) Patent No.: US 12,378,863 B1
(45) Date of Patent: Aug. 5, 2025

(54) METHOD AND DEVICE FOR DETERMINING FRACTURE CLOSURE PRESSURE BASED ON HYDRAULIC FRACTURING

(71) Applicant: Institute of Geomechanics, Chinese Academy of Geological Sciences, Beijing (CN)

(72) Inventors: Yuehui Yang, Beijing (CN); Dongsheng Sun, Beijing (CN); Qunce Chen, Beijing (CN); Awei Li, Beijing (CN); Bangchen Wu, Beijing (CN)

(73) Assignee: Institute of Geomechanics, Chinese Academy of Geological Sciences, Beijing (CN)

( * ) Notice: Subject to any disclaimer, the term of this patent is extended or adjusted under 35 U.S.C. 154(b) by 0 days.

(21) Appl. No.: 19/007,494

(22) Filed: Jan. 1, 2025

(30) Foreign Application Priority Data

May 15, 2024 (CN) ..... 202410600968.1

(51) Int. Cl.
*E21B 43/26* (2006.01)
*E21B 49/00* (2006.01)

(52) U.S. Cl.
CPC ..... *E21B 43/26* (2013.01); *E21B 49/008* (2013.01); *E21B 2200/20* (2020.05)

(58) Field of Classification Search
CPC ..... E21B 43/26; E21B 49/008; E21B 49/006
See application file for complete search history.

(56) References Cited

U.S. PATENT DOCUMENTS 4,398,416 A * 8/1983 Nolte ..... E21B 43/26 166/250.1
5,050,674 A * 9/1991 Soliman ..... E21B 43/26 166/308.1
5,305,211 A * 4/1994 Soliman ..... E21B 49/006 166/250.1
8,606,524 B2 * 12/2013 Soliman ..... G01N 15/0826 702/12

(Continued)

OTHER PUBLICATIONS

CNIPA, Notification of a First Office Action for CN202410600968.1, Jun. 18, 2024.

(Continued)

*Primary Examiner* — Kenneth L Thompson
(74) *Attorney, Agent, or Firm* — Hemisphere Law, PLLC; Zhigang Ma

(57) ABSTRACT

A method and a device for determining fracture closure pressure based on hydraulic fracturing are provided. The method includes: determining a leak-off volume of a fluid during a refrac cycle according to a fluid pressure during the refrac cycle; generating a stiffness change curve during the refrac cycle according to the leak-off volume of the fluid and the fluid pressure; and determining the fracture closure pressure according to the stiffness change curve. A hydraulic coupling mechanism and change characteristics during a pressure attenuation process are quantitatively characterized, and characteristic response corresponding to a pressure drop curve before and after the fracture closure are accurately described, thereby providing a method and a device for determining fracture closure pressure with clear physical significance and objective effectiveness.

9 Claims, 12 Drawing Sheets

(56) References Cited

U.S. PATENT DOCUMENTS

| | | | | |
|---|---|---|---|---|
| 9,500,076 | B2 * | 11/2016 | Walters | E21B 43/26 |
| 10,954,775 | B2 * | 3/2021 | Islam | E21B 47/06 |
| 10,982,535 | B2 * | 4/2021 | Wang | E21B 49/008 |

OTHER PUBLICATIONS

Institute of Geomechanics, Chinese Academy of Geological Sciences (Applicant), Replacement claims (allowed) of CN202410600968.1, Jul. 11, 2024.

CNIPA, Notification to grant patent right for invention in CN202410600968.1, Jul. 26, 2024.

* cited by examiner

METHOD AND DEVICE FOR DETERMINING FRACTURE CLOSURE PRESSURE BASED ON HYDRAULIC FRACTURING

CROSS-REFERENCE TO RELATED APPLICATION

This application claims priority to Chinese Patent Application No. 202410600968.1, filed on May 15, 2024, which is herein incorporated by reference in its entirety.

TECHNICAL FIELD

The disclosure relates to the field of crustal stress (also referred to as in-situ stress) measurement technologies, and more particularly to a method and a device for determining fracture closure pressure based on hydraulic fracturing.

BACKGROUND

Hydraulic fracturing (HF) technology is one of the most direct and effective methods to determine rock mass stress. Since the Rangely Oilfield in Colorado, USA used this method to obtain deep stress states and establish a water injection-induced fault instability model, the HF method has become an indispensable technical means in the design of large-scale underground projects, such as hydropower stations, deep buried tunnels, mines, deep buried disposal of nuclear waste, underground gas storage construction, unconventional oil and gas and geothermal energy development. The HF method has also become the main in-situ crustal stress measurement method in basic research on geodynamics, active fault risk assessment, earthquake prediction and other studies.

The fracture closure pressure in the HF technology is usually used to determine a minimum principal stress or minimum horizontal principal stress (near vertical borehole) of the formation, and used as a key mechanical parameter to calculate a maximum horizontal principal stress together with a reopening pressure. Therefore, it is of great significance to accurately and objectively pick up the fracture closure pressure from the measured curve for improving the reliability of the crustal stress test results by the HF method. At present, the researchers engaged in crustal stress measurement of the HF method have proposed more than ten data analysis methods for picking up the closure pressure, such as the commonly used single tangent method, Muskat method, dP/dT method, and dT/dP method. These methods are proposed before 2000, and most of them are based on analysis modes of tangent or optimal fit algorithm. Although these methods have played an important role in interpreting HF experimental data, there is still ambiguity and uncertainty in the determination of the closure pressure in practical applications, which is mainly manifested as follows.

(1) With impact of the time window range, especially the single tangent method, it brings large errors and arbitrariness to the determination of the fracture closure pressure.

(2) The value points lack a clear physical definition when analyzing the fracture closure pressure using the single tangent method, the dP/dT method and the Muskat method.

(3) The International Society for Rock Mechanics and Engineering (ISRM) recommends using the dT/dP method to obtain the pressure when the fracture tip stops expanding, and using the dP/dT method to obtain the pressure when the fracture is completely closed, which are used as the upper and lower limits of the closure pressure respectively. However, in practical applications, the upper and lower limits obtained using the above methods are still uncertain, and the upper limit may even be lower than the lower limit, which is obviously unreasonable.

SUMMARY

A purpose of the disclosure is to provide a method for determining fracture closure pressure based on hydraulic fracturing. The method quantitatively characterizes a hydraulic coupling mechanism and change characteristics during a pressure attenuation process, and accurately describes characteristic response corresponding to a pressure drop curve before and after the fracture closure, thereby providing a method for determining fracture closure pressure with clear physical significance and objective effectiveness.

Another purpose of the disclosure is to provide a device for determining fracture closure pressure based on hydraulic fracturing. Still another purpose of the disclosure is to provide an electronic device, the electronic device includes a memory and a processor. The memory stores a computer program, and the computer program is configured to be executed by the processor to implement the steps of the above method for determining fracture closure pressure based on hydraulic fracturing. Still another purpose of the disclosure is to provide a non-transitory computer-readable storage medium having the computer program stored therein, and the computer program is configured to be executed by the processor to implement the steps of the above method for determining fracture closure pressure based on hydraulic fracturing.

In order to solve the technical problems in background of the disclosure, the disclosure provides the following technical solutions.

In the first aspect, the disclosure provides a method for determining fracture closure pressure based on hydraulic fracturing, including:

- determining a leak-off volume of a fluid during a refrac cycle according to a fluid pressure during the refrac cycle;
- generating a stiffness change curve during the refrac cycle according to the leak-off volume of the fluid and the fluid pressure; and
- determining the fracture closure pressure according to the stiffness change curve.

In some embodiments of the disclosure, the leak-off volume is a cumulative leak-off volume during the refrac cycle. The determining a leak-off volume of a fluid during a refrac cycle according to a fluid pressure during the refrac cycle includes:

- generating a C function according to a pressure curve corresponding to the fluid pressure; where the C function has a linear relationship with a cumulative leak-off volume of the fluid; and
- determining the cumulative leak-off volume of the fluid according to the C function.

In some embodiments of the disclosure, the generating a C function according to a pressure curve corresponding to the fluid pressure includes:

- determining an instantaneous leak-off flow rate of the fluid during the refrac cycle according to a Carter leak-off model and the pressure curve; and
- generating the C function according to the instantaneous leak-off flow rate of the fluid.

In some embodiments of the disclosure, the determining the fracture closure pressure according to the stiffness change curve includes:

determining a continuous closure stage of a fracture according to the stiffness change curve; where the continuous closure stage of the fracture is a stage from fracture tip closure to fracture completion closure; and determining the fracture closure pressure according to a stiffness change curve corresponding to the continuous closure stage of the fracture.

In some embodiments of the disclosure, the determining the fracture closure pressure according to a stiffness change curve corresponding to the continuous closure stage of the fracture includes:

determining the fracture closure pressure according to fluid pressures corresponding to two ends of the continuous closure stage of the fracture on the stiffness change curve.

In the second aspect, the disclosure provides a device for determining fracture closure pressure based on hydraulic fracturing, and the device includes a leak-off volume determination module, a stiffness change curve generation module and a closure pressure determination module. The leak-off volume determination module is configured to determine a leak-off volume of a fluid during a refrac cycle according to a fluid pressure during the refrac cycle. The stiffness change curve generation module is configured to generate a stiffness change curve during the refrac cycle according to the leak-off volume of the fluid and the fluid pressure. The closure pressure determination module is configured to determine the fracture closure pressure according to the stiffness change curve.

In some embodiments of the disclosure, the leak-off volume is a cumulative leak-off volume during the refrac cycle. The leak-off volume determination module includes a C function generation unit and a leak-off volume determination unit. The C function generation unit is configured to generate a C function according to a pressure curve corresponding to the fluid pressure; and the C function has a linear relationship with the cumulative leak-off volume of the fluid. The leak-off volume determination unit is configured to determine the cumulative leak-off volume of the fluid according to the C function.

In some embodiments of the disclosure, the C function generation unit includes an instantaneous leak-off flow rate determination unit and a C function generation sub unit. The instantaneous leak-off flow rate determination unit is configured to determine the instantaneous leak-off flow rate of the fluid during the refrac cycle according to the Carter leak-off model and the pressure curve. The C function generation sub unit is configured to generate the C function according to the instantaneous leak-off flow rate of the fluid.

In some embodiments of the disclosure, the closure pressure determination module includes a closure stage determination unit and a closure pressure determination unit. The closure stage determination unit is configured to determine a continuous closure stage of a fracture according to the stiffness change curve; and the continuous closure stage of the fracture is a stage from fracture tip closure to fracture completion closure. The closure pressure determination unit is configured to determine the fracture closure pressure according to a stiffness change curve corresponding to the continuous closure stage of the fracture.

In some embodiments of the disclosure, the closure pressure determination unit includes a closure pressure determination sub unit. The closure pressure determination sub unit is configured to determine the fracture closure pressure according to fluid pressures corresponding to two ends of the continuous closure stage of the fracture on the stiffness change curve.

In an exemplary embodiment, each of the leak-off volume determination module, the stiffness change curve generation module, the closure pressure determination module, the C function generation unit, the leak-off volume determination unit, the instantaneous leak-off flow rate determination unit, the C function generation sub unit, the closure stage determination unit, the closure pressure determination unit, and the closure pressure determination sub unit is embodied by software stored in at least one memory and executable by at least one processor.

In the third aspect, the disclosure provides a computer program product, including a computer program/instruction, the computer program/instruction is configured to be executed by a processor to implement the steps of the method for determining fracture closure pressure based on hydraulic fracturing.

In the fourth aspect, the disclosure provides an electronic device, including a memory, a processor, and a computer program stored in the memory and executed in the processor. The computer program is configured to be executed by the processor to implement the steps of the method for determining fracture closure pressure based on hydraulic fracturing.

In the fifth aspect, the disclosure provides a non-transitory computer-readable storage medium having the computer program stored therein, and the computer program is configured to be executed by the processor to implement the steps of the method for determining fracture closure pressure based on hydraulic fracturing.

It can be seen from the above descriptions that the embodiments of the disclosure provide a method and a device for determining fracture closure pressure based on hydraulic fracturing, and the method includes: determining the leak-off volume of the fluid during the refrac cycle according to the fluid pressure during the refrac cycle; generating the stiffness change curve during the refrac cycle according to the leak-off volume of the fluid and the fluid pressure; and determining the fracture closure pressure according to the stiffness change curve.

The device includes the leak-off volume determination module, the stiffness change curve generation module and the closure pressure determination module. The leak-off volume determination module is configured to determine the leak-off volume of the fluid during the refrac cycle according to the fluid pressure during the refrac cycle. The stiffness change curve generation module is configured to generate the stiffness change curve during the refrac cycle according to the leak-off volume of the fluid and the fluid pressure. The closure pressure determination module is configured to determine the fracture closure pressure according to the stiffness change curve.

The disclosure quantitatively characterizes a hydraulic coupling mechanism and change characteristics during a pressure attenuation process, and accurately describes characteristic response corresponding to a pressure drop curve before and after the fracture closure, thereby providing a method for determining fracture closure pressure with clear physical significance and objective effectiveness.

BRIEF DESCRIPTION OF DRAWINGS

In order to describe technical solutions in embodiments of the disclosure or related art more clearly, drawings required in descriptions of the embodiments or the related art will be simply introduced below. Apparently, the drawings in the following descriptions are some of the embodiments of the disclosure, for those skilled in the art, other drawings can be obtained based on these drawings without creative work.

DETAILED DESCRIPTION OF EMBODIMENTS

In order to make purposes, technical solutions and advantages of embodiments of the disclosure clearer, the technical solutions in the embodiments of the disclosure will be clearly and completely described below in conjunction with drawings in the embodiments of the disclosure. Apparently, the described embodiments are some of the embodiments of the disclosure, not all of them. Based on the embodiments of the disclosure, all other embodiments obtained by those skilled in the art without creative work are within a scope of protection of the disclosure.

It will be appreciated by those skilled in the art that the embodiments of the disclosure may be provided as methods, systems, or computer program products. Therefore, the disclosure may take the form of a complete hardware embodiment, a complete software embodiment, or an embodiment combining software and hardware. Furthermore, the disclosure may take the form of a computer program product implemented on one or more computer-usable storage medium (including but not limited to disk storage, compact disc read-only memory abbreviated as CD-ROM and optical storage) containing computer-usable program code.

It should be noted that terms "including" and "having" in the specification, claims and the above-mentioned drawings of the disclosure, and any variations thereof are intended to cover non-exclusive inclusions. For example, including a process, a method, a system, a product or a device including a series of steps or units that is not necessarily limited to those steps or units clearly listed, but may include other steps or units that are not clearly listed or inherent to these processes, methods, products or devices. In the absence of conflict, the embodiments in the disclosure and the features in the embodiments may be combined with each other. The disclosure will be described in detail below with reference to the drawings and in combination with the embodiments.

In the related art, a single tangent method and a Muskat method are two commonly used data analysis methods for picking up closure pressure.

The single tangent method is a simple graphical technology that evolved from an inflection point method and was successfully applied by J. M. Gronsech et al. (J. M. Gronsech et al., In-situ stresses and hydraulic fracturing in the deep basin, Journal of Canadian Petroleum Technology, November 1983, pages 31-35, volume 22, issue 06) to high modulus crystalline rocks.

Figure 1:
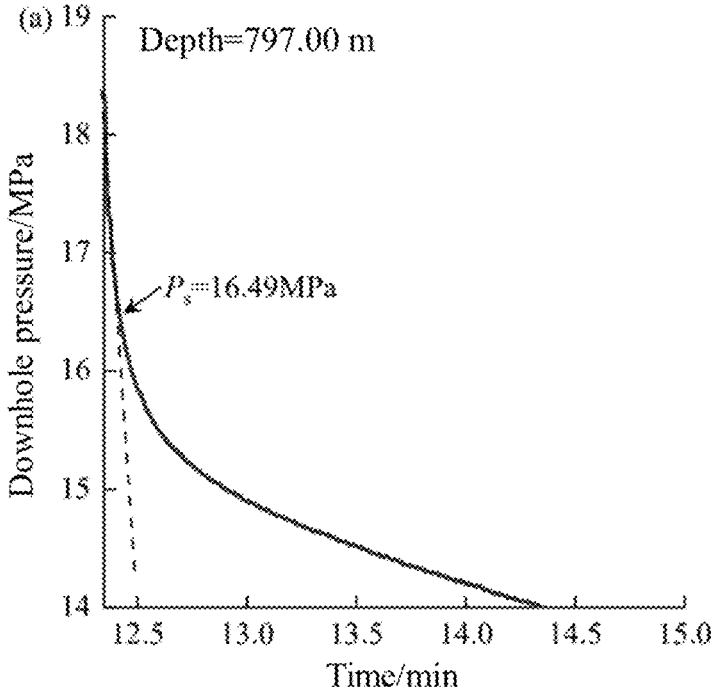
FIG. 1 (Related Art)
FIG. 1 illustrates a schematic diagram of a single tangent method with a time window of a general scale in the related art.
Figure 2:
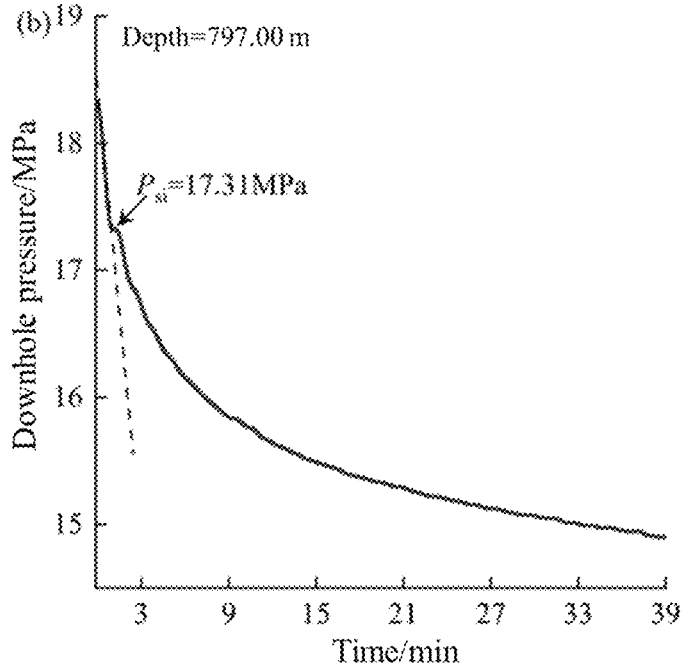
FIG. 2 (Related Art)
FIG. 2 illustrates a schematic diagram of a single tangent method with a time window of an enlarged scale in the related art.

In practice, there are two single tangent methods, one is manual line reading and the other is computer program reading. Relatively speaking, the former is more adaptable to curves with different morphological characteristics, but the visual value is seriously affected by the time scale and is more arbitrary. The main function of the latter is to overcome the arbitrariness of manual visual value taking and improve the efficiency of data analysis. However, whether it is manual line reading or with the help of computer programs, there is a certain degree of subjectivity in the selection of near-linear pressure drop sections and the confirmation of deviation points. As shown in FIG. 1, when the time window is reduced to about 20 to 50 seconds, the pressure value obtained by the tangent method is higher than that in FIG. 2.

Although the single tangent method is relatively simple to apply, it is seriously affected by the time window. It is often difficult to obtain consistent results when this method is applied to different cycles of the same test curve, or is applied to the same cycle and is selected by different data processors. In fact, the pressure points determined by this method lack clear and reasonable physical meanings and are difficult to apply to test curves of different shapes.

M. Muskat proposed this radial flow-induced exponential pressure attenuation model based on a flow law of a fluid in boreholes and porous rock mass to analyze and predict the bottom hole pressure change of oil wells, which is also called exponential pressure attenuation method or nonlinear regression method. This method assumes that after the fracture is closed, there is no fluid leak-off through the fracture, and the fluid only seeps into the rock mass through the hole wall. Then the stress attenuation in the borehole testing section should satisfy the following formula (sometimes also in its natural logarithmic form):

$$P=\exp(d_1t+d_2)+P_a, t\geq t_r \quad (1);$$

where P represents a pressure in a testing section, $d_1$ (<0) and $d_2$ each represent an undetermined parameter characterizing pressure attenuation, $P_a$ represents a gradual pressure in the testing section, t represents a time, and $t_r$ represents a starting time of a pure radial flow (the corresponding fracture is closed completely).

Figure 3:
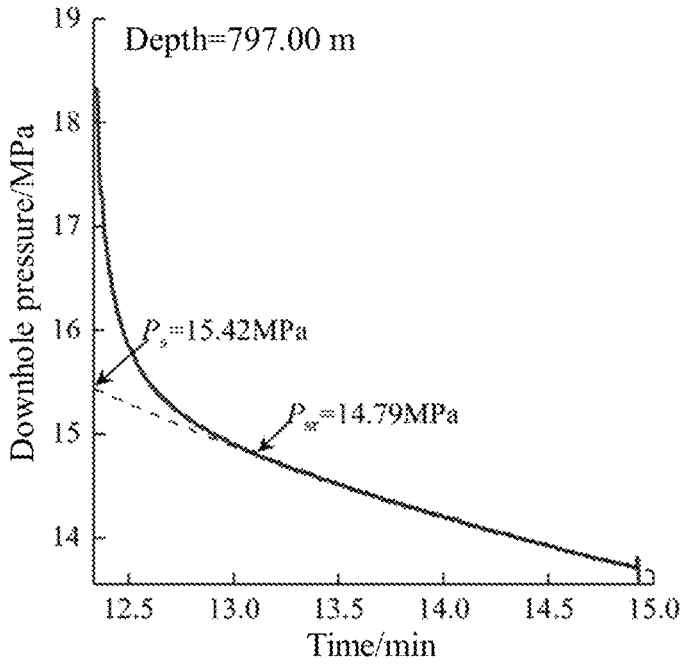
FIG. 3 (Related Art)
FIG. 3 illustrates a schematic diagram of a Muskat method in the related art.

R. L. Aamodt et al. (R. L. Aamodt et al., Measurement of instantaneous shut-in pressure in crystalline rock, Workshop on Hydraulic Fracturing Stress Meas, 1981) and M. Y. Lee et al. (M. Y. Lee et al., Statistical evaluation of hydraulic fracturing stress measurement parameters, International Journal of Rock Mechanics & Mining Sciences & Geomechanics Abstracts, 1989, pages 447-456, volume 26, issue 6) applied the method to identify the closure pressure during a shut-in period of a HF testing curve, and summarized the analysis process. The analysis process of the method is generally to select the pressure-time data of the pressure drop interval after turning off a pump based on a computer program, recursively push back along the left boundary of the time interval, use the formula (1) to perform nonlinear fitting on the interval data and record the fitting residual, and finally obtain the fitting parameters corresponding to the minimum residual or the residual stable to the specified threshold, which is the optimal solution, as shown in FIG. 3. M. Y. Lee et al. pointed out that (1) $P_{sr}$ corresponds to the complete closure of the fracture (i.e., $t_r$ moment), and starting of the pure radial flow, which is a maximum pressure in the data involved in the exponential fitting; (2) The pressure value corresponding to a time for turning off the pump when the fitting curve is pushed back is $P_s$, which represents the pressure required to maintain the same radial flow under the assumption that the fracture is closed immediately after turning off the pump, and can be used as an approximate value of the minimum principal stress. L. S. Cheung et al. (L. S. Cheung et al., Laboratory study of hydraulic fracturing pressure data—how valid is their conventional interpretation?International Journal of Rock Mechanics and Mining Sciences & Geomechanics Abstracts, December 1989, pages 595-604, volume 26, issue 6) applied the Maskat method to the processing of indoor fracturing experimental data and found that the obtained $P_s$ is closer to the minimum horizontal principal stress of the actual loading, while $P_{sr}$ is usually lower.

Due to factors such as the roughness of the fracture wall surface, the fractures often cannot be completely closed and there is a residual fracture width and conductivity. Therefore, in many cases, the assumption that the fluid only seeps into the rock mass through the hole wall after the fracture is closed cannot be met, especially for low-permeability formations. At the same time, this method takes the pressure value corresponding to the time for turning off the pump as $P_s$, which lacks a clear physical significance. The explanation given by M. Y. Lee et al. is also somewhat vague and far-fetched. In addition, this method is affected by the time window to a certain extent.

Based on the above-mentioned technical pain points, the acquisition, storage, use, and processing of data in the technical solution of the disclosure comply with the relevant provisions of laws and regulations.

Figure 4:
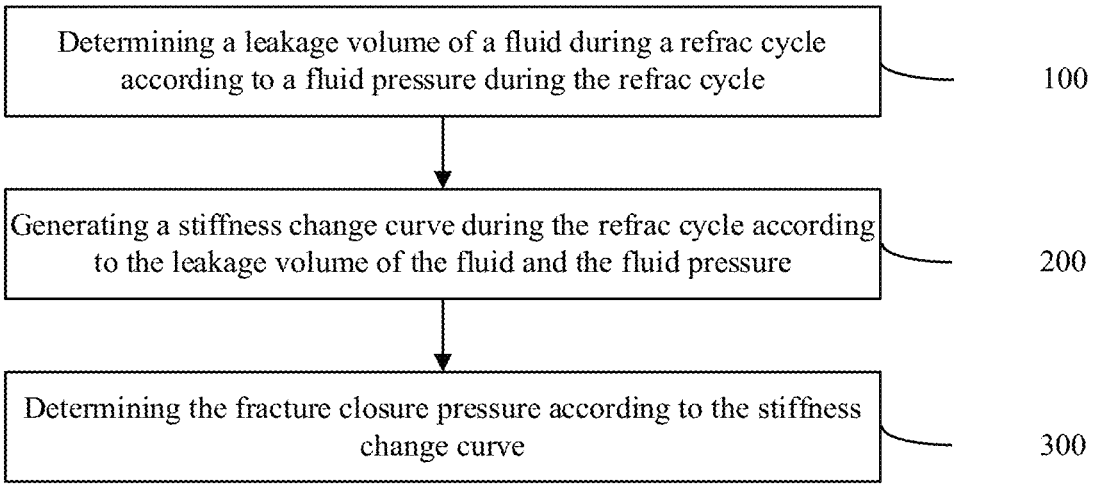
FIG. 4 illustrates a flowchart of a method for determining fracture closure pressure based on hydraulic fracturing according to an embodiment of the disclosure.

An embodiment of the disclosure provides a method for determining fracture closure pressure based on hydraulic fracturing, as shown in FIG. 4, the method specifically includes the following steps 100-300.

In step 100, a leak-off volume of a fluid during a refrac cycle is determined according to a fluid pressure during the refrac cycle.

In step 200, a stiffness change curve during the refrac cycle is generated according to the leak-off volume of the fluid and the fluid pressure.

In step 300, the fracture closure pressure is determined according to the stiffness change curve.

It can be seen from the above descriptions that the embodiments of the disclosure provides a method for determining fracture closure pressure based on hydraulic fracturing, and the method includes the follows. Firstly, the leak-off volume of the fluid during the refrac cycle is determined according to the fluid pressure during the refrac cycle. Secondly, the stiffness change curve during the refrac cycle is generated according to the leak-off volume of the fluid and the fluid pressure. Finally, the fracture closure pressure is determined according to the stiffness change curve.

The disclosure quantitatively characterizes a hydraulic coupling mechanism and change characteristics during a pressure attenuation process, and accurately describes characteristic response corresponding to a pressure drop curve before and after the fracture closure, thereby providing a method for determining fracture closure pressure with clear physical significance and objective effectiveness.

Figure 5:
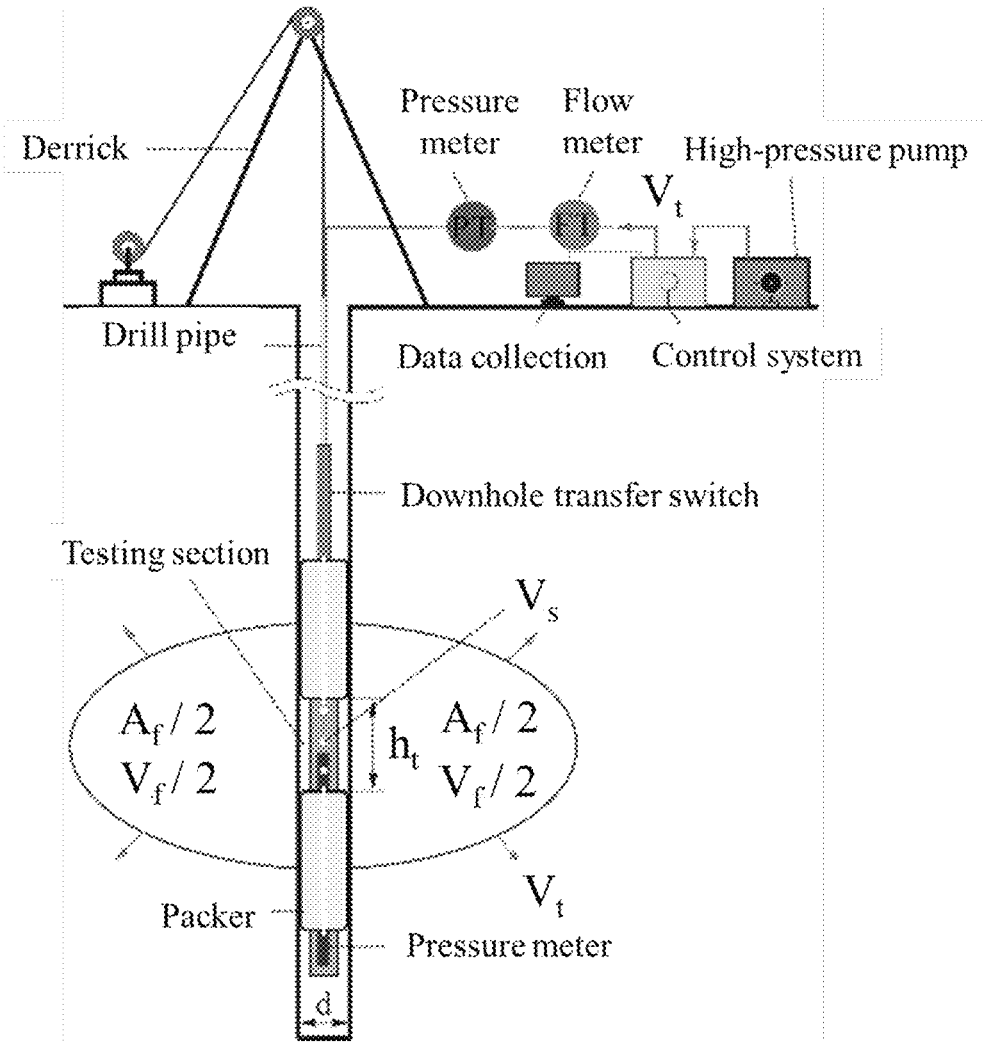
FIG. 5 illustrates a schematic structural diagram of a basic device and a testing system for measuring crustal stress using a HF method according to an embodiment of the disclosure.
Figure 6:
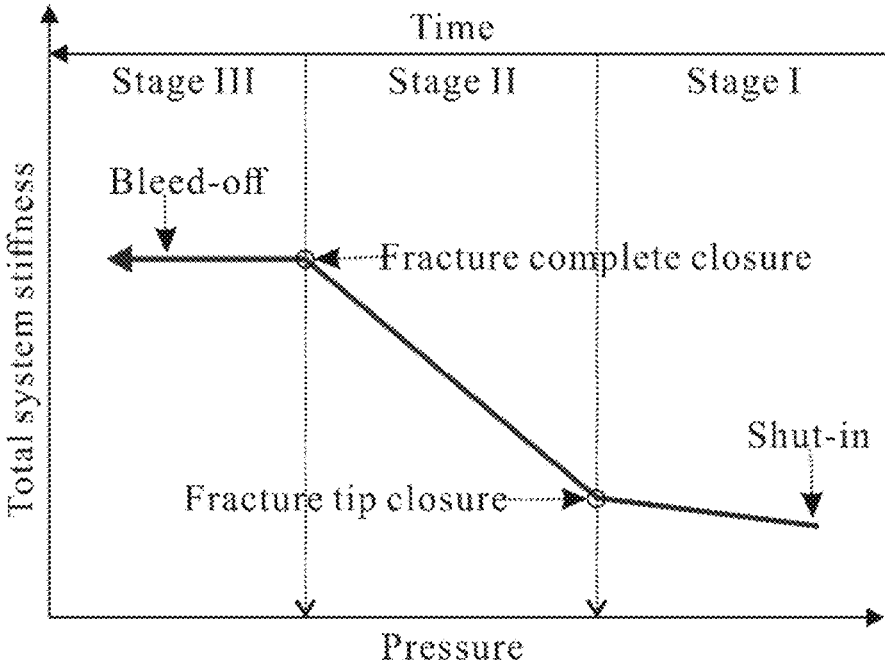
FIG. 6 illustrates a schematic diagram of an idealized curve for the total system stiffness versus interval pressure during the shut-in period according to an embodiment of the disclosure.

In some embodiments of the disclosure, for the step 100, FIG. 5 illustrates a schematic structural diagram of a basic device and a testing system for measuring crustal stress using a HF method according to an embodiment of the disclosure. In the measurement of the HF method, a section of open hole boreholes are sealed through two packers, and fracturing fluid (usually water) is injected into the section of open hole boreholes with a constant rate until the rock fractures. After the rock fractures, the fracturing fluid is injected for an additional period of time to extend the fracture, then the pump is turned off to keep the whole system sealed for a period of time, and the pressure is released to the atmospheric level. Usually, the above operation process is repeated several times after the fracturing cycle, which is called the refrac cycle. A closure pressure P % and a reopening pressure Pr are determined based on an experimental curve of the refrac cycle. FIG. 6 illustrates a schematic diagram of a typical experimental pressure-flow-time curve of the HF method given by ISRM.

In some embodiments of the disclosure, for the step 200, it can be understood that the stiffness in the step 200 refers to the stiffness of a testing system of the fracture closure pressure. Specifically, the stiffness refers to ability of the testing system to resist deformation under force. The stiffness is a characteristic of a testing system to resist deformation, which is usually used to describe a stiffness degree of materials or structures. The stiffness can be used to measure a relationship between a displacement of the testing system after being subjected to force and the applied force. A unit of measurement of the stiffness is Newton per meter (N/m) or Newton per millimeter (N/mm), which indicates the force required per unit length to produce a displacement per unit length. The greater the stiffness, the smaller the displacement of the testing system under force, that is, the smaller the deformation of the testing system, the higher the stiffness.

Firstly, during the experiment, a change of a measured pressure P is directly related to a change of a fluid volume V in the testing system and the fracture, rather than the time t, and a chain decomposition is performed on dP/dt as follows:

$$\frac{dP}{dt} = \frac{dP}{dV}\frac{dV}{dt} = \begin{Bmatrix} S_t\dfrac{dV_I - dV_L}{dt} \\ -S_t\dfrac{dV_L}{dt} \end{Bmatrix} = \begin{Bmatrix} S_t(Q_I - Q_L) \\ -S_tQ_L \end{Bmatrix} \approx \begin{Bmatrix} S_tQ_I \text{ injection stage} \\ -S_tQ_L \text{ pressure attenuation stage} \end{Bmatrix}; \tag{2}$$

where V represents the fluid volume in the testing system and the fracture; dP/dV represents a stiffness $S_t$ of the testing system; dV/dt represents an instantaneous flow rate of the fluid; $V_I$ represents a cumulative injection volume of the fluid of the testing section, and $V_L$ represents a cumulative leak-off volume of the fluid of the testing section, as shown in FIG. 5; $Q_I$ ($=V_I/t$) represents an instantaneous injection flow rate, which can be regarded as a constant value during the experiment; and $Q_L$ represents an instantaneous leak-off flow rate, since $Q_I >> Q_L$ in general, $Q_L$ is omitted in the injection stage.

The formula (2) shows that evolution of the pressure-time curve of the testing section is jointly controlled by the stiffness $S_t$ of the testing system and the instantaneous flow rate dV/dt of the fluid at different times. For the injection stage, dV/dt can be approximately equal to $Q_I$, which is a constant value. For the pressure attenuation stage, dV/dt is completely determined by $Q_L$, and dV/dt continues to decrease monotonically as P decreases. Therefore, dV/dt cannot effectively indicate the opening and closing states of the fracture, which is the main reason for the ambiguity of the above-mentioned existing methods. Therefore, it is necessary to focus on analyzing a first key component $S_t$ that is coupled with dV/dt. In theory, the stiffness $S_t$ of the testing system can also be represented by using compliance form superposition as follows:

$$S_t = \frac{dP}{dV} = \frac{1}{C_t} = \frac{1}{\frac{1}{S_f} + \frac{1}{S_s}} \approx \frac{1}{\frac{dV_f}{dP} + V_s c_w} = \frac{1}{\frac{A_f dw_{fm}}{dP} + V_s c_w}; \tag{3}$$

where $C_t$ represents a total system compliance (the stiffness and the compliance are reciprocals of each other); $A_f$ represents a total area of the fracture, and $V_f$ represents a total volume of the fracture; $V_s$ represents a volume of a fracturing section and a drill pipe, which can be calculated according to the actual working conditions; $S_f$ represents a stiffness of the fracture, which is controlled by a size of the fracture and elastic modulus and a Poisson's ratio of the rock, and $S_f$ can be also determined by $dV_f/dP$; $S_s$ represents a water stiffness of the testing system, which can be determined by $V_s c_w$, and can also be determined by a slope of a pressure and a cumulative injection volume during a pressure-boosting stage of the fracturing cycle; $c_w$ represents a compressibility coefficient of the fluid; and $w_{fm}$ represents an average width of the fracture. It should be pointed out that deformation of the drill pipe and the packers is not considered in the formula (3), since the deformation of the drill pipe and the packers can be ignored relative to a water compliance. In addition, compressibility of the fluid in the fracture is not considered in the formula (3), since $V_f c_w << V_s c_w$ under usual conditions.

According to the formula (3), as the fluid pressure decreases, the size of the fracture will inevitably decrease, so that $S_f$ will increase, leading to an increase in $S_t$. As the fracture begins to close at the tip, the contact of the fracture walls will cause $dw_{fm}$ begin to decrease significantly, thereby causing $S_t$ to start increasing rapidly. When the fracture tends to be completely closed, $S_f$ will tend to infinity, that is, $dw_{fm}$ will tends to zero, and $S_t$ will be completely dominated by $V_s c_w$ approaching a stable value. Therefore, the evolution of $S_t$ is closely related to the closing process of the hydraulic fracture, and there is a direct correspondence. FIG. 6 illustrates a schematic diagram of an idealized curve for the total system stiffness versus interval pressure during the shut-in period, the curve changes as the fracture closes, and after shut-in, the two inflection points on the curve correspond to the fracture tip closure and complete closure, respectively.

In some embodiments of the disclosure, when the step 300 is implemented, a change trend of the stiffness change curve is determined, and them the fracture closure pressure is determined according to the change trend.

Figure 8:
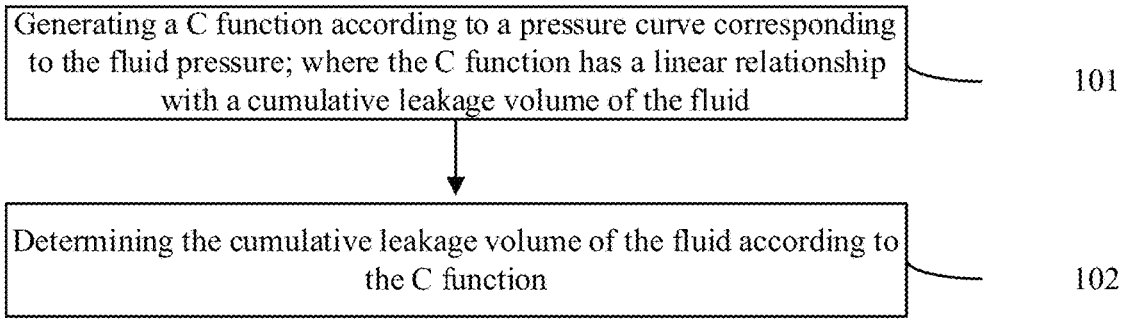
FIG. 8 illustrates a flowchart of a step 100 of the method for determining fracture closure pressure based on hydraulic fracturing according to an embodiment of the disclosure.

In some embodiments of the disclosure, the leak-off volume is a cumulative leak-off volume during the refrac cycle. As shown in FIG. 8, the step 100 of the method for determining fracture closure pressure based on hydraulic fracturing includes the following steps 101-102.

In step 101, a C function is generated according to a pressure curve corresponding to the fluid pressure. The C function has a linear relationship with the cumulative leak-off volume of the fluid.

In step 102, the cumulative leak-off volume of the fluid is determined according to the C function.

Figure 9:
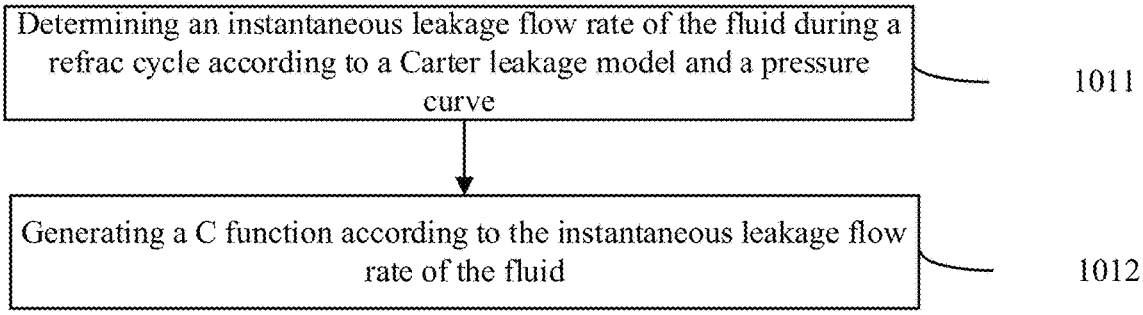
FIG. 9 illustrates a flowchart of a step 101 of the method for determining fracture closure pressure based on hydraulic fracturing according to an embodiment of the disclosure.

In some embodiments of the disclosure, as shown in FIG. 9, the step 101 of the method for determining fracture closure pressure based on hydraulic fracturing includes the following steps 1011-1022.

In step 1011, the instantaneous leak-off flow rate of the fluid during the refrac cycle is determined according to a Carter leak-off model and the pressure curve.

It can be seen from the formula (2) that as the fluid pressure decreases, the size of the fracture will inevitably decrease, and $S_f$ will inevitably continue to increase, which will lead to an increase in $S_t$. When a fracture tip begins to close, $dw_{fm}$ begins to decrease significantly caused by the contact of the fracture walls, resulting in a rapid increase in $S_t$. When the fracture tends to completely close, $S_f$ will tend to infinity, that is, $dw_{fm}$ tends to zero, and $S_t$ will be completely dominated by $V_s c_w$, and will approximately tend to a stable value. According to the above analysis, it can be seen that the evolution of $S_t$ is closely related to the closure process of the fracture, and there is a direct corresponding relationship.

Figure 7:
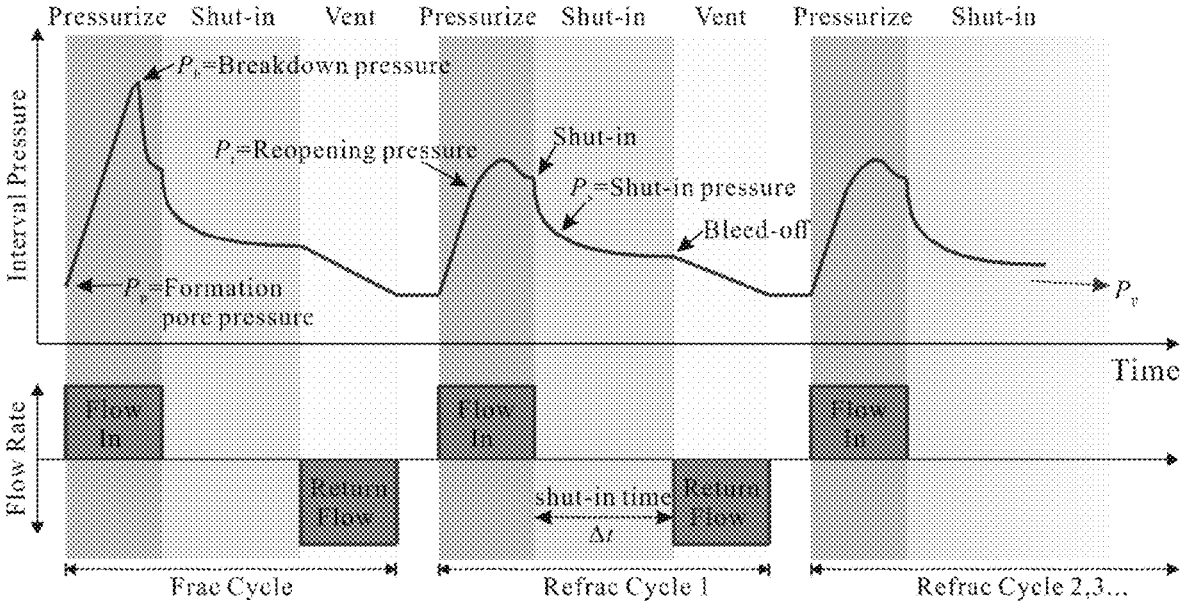
FIG. 7 illustrates a schematic diagram of a typical experimental curve of the HF method according to an embodiment of the disclosure.

In order to obtain change information of the stiffness of the testing system from a pressure-time curve of the refrac cycle, a constitutive relationship (a relationship between a stress tensor and a strain tensor) characterizing the volume change of the system needs to be constructed and derived, that is, a change process of P and V under different time needs to be understood. Specifically, P can be obtained by a ground or downhole pressure meter during the experiment, thus the key is to analyze the volume V, that is, $V_L$, since $V_S$ and $V_I$ are known in an actual test. In order to objectively and simply derive a relationship expression between $V_L$ and $\Delta t$ (from the time for turning off the pump to a time for releasing pressure, as shown in FIG. 7), the following assumptions are performed.

(1) The pressures P of the fluid in the fracturing section and the fracture are equal, that is, a pressure gradient problem is not considered.

(2) A pore pressure $P_p$, a fluid viscosity $\mu$, a porosity $\phi$, a compressibility factor $c_t$ and a permeability k of the rock mass in the testing section are all independent of P.

(3) The leak-off of the fluid follows the Carter leak-off model, that is, only the flow perpendicular to the rock wall is considered, and the penetration parallel to the fracture wall is ignored.

(4) During the refrac cycle, the fracture surface area (i.e., the total area of the fracture) exists and remains constant from the beginning of injection until the fracture is closed.

It should be noted that the above assumption (4) is equivalent to assuming that the fracture still has a residual width after closure or when injection begins, and it still maintains hydraulic conductivity. It also implicitly assumes that the fracture does not expand further during the refrac cycle, or that the area of further expansion of the fracture wall is very limited and can be approximately ignored. This is also in line with the requirements of relevant specifications or recommended methods. For example, the ISRM recommended method clearly points out that the injection time and rate of the refrac cycle need to be strictly controlled. Once the fracture is fully opened, that is, when the pressure grows to a basically stable level, the injection is stopped to avoid further expansion of the fracture tip.

The relationship between the cumulative leak-off volume $V_L$ and the time interval $\Delta t$ are derived on the basis of the above assumptions. A total seepage area A is composed of the total area of the fracture and a side area of the fracturing section, that is:

$$A=A_f+\phi d h_t \quad (4);$$

where $h_t$ represents a length of the fracturing section, d represents a diameter of a borehole (as shown in FIG. 5). It can be seen from the assumption (4) that the total seepage area A is considered a constant during the refrac cycle. Therefore, an instantaneous leak-off flow rate $Q_L$ of the fluid occurred by the total area of the fracture and the side area of the fracturing section is derived based on the Carter leak-off model as follows:

$$Q_L = \frac{A(P(t)-P_p)\sqrt{\frac{\phi c_t k}{\pi\mu}}}{\sqrt{t}} = \frac{A\Psi(P(t)-P_p)}{\sqrt{t}}; \quad (5)$$

where t represents a duration of fluid penetration; the square root in the numerator is denoted as a constant $\Psi$ according to assumptions; the pore pressure of the rock $P_p$ can be estimated by identifying the minimum value of the pressure-time curve in the HF test (see FIG. 7); for HF testing with small injection volumes and time, the pore pressure disturbance caused by leak-off is slight and negligible; this is a relatively reasonable assumption, especially for low-permeability rocks.

In step 1012, the C function is generated according to the instantaneous leak-off flow rate of the fluid.

A right side in the formula (5) changes only when the fluid pressure P changes with time during the experiment. In order to consider the problem that the instantaneous leak-off flow rate $Q_L$ of the fluid depends on a pressure difference $(P-P_p)$ and changes with time. By integrating the formula (5) over the total shut-in time $\Delta t$ (also referred to the time interval from shut-in to bleed-off), the cumulative leak-off volume $V_L$ of the fluid after shut-in (t=0) can be obtained as follows:

$$V_L(t) = A\Psi\int_0^{\Delta t}\frac{P(t)-P_p}{\sqrt{t}}dt. \quad (6)$$

The pressure data P(t) in the formula (5) or (6) can be obtained from the pressure meter. During the shut-in period, as P(t) decreases, the pressure difference $(P(t)-P_p)$ also decreases over time. However, it is not possible to describe P(t) using a simple and accurate mathematical formula. To address the relationship between the cumulative leak-off volume $V_L$ of the fluid and the pressure difference $(P(t)-P_p)$ over time in the formula (6), it is necessary to divide the total shut-in time $\Delta t$ (see FIG. 6) equally into n small time intervals $\tau$, This can be expressed as:

$$\tau=\Delta t/n \quad (7);$$

Therefore, under the condition of known measured pressure data P(t) and shut-in time $\Delta t$, the formula (6) can be expanded into a discrete form by using the summation formula:

$$V_L = A\Psi\sum_{i=1}^{n}\left(\tau\frac{P(i)-P_P}{\sqrt{i\tau}}\right) = A\Psi\sqrt{\tau}\sum_{i=1}^{n}\left(\frac{P(i)-P_P}{\sqrt{i}}\right) = A\Psi\sqrt{\tau}\,C; \quad (8)$$

where $\tau$ represents a constant since the data acquisition frequency remains constant during a HF test, in general; the integer n represents the total number of pressure points collected during the shut-in period, which is a known number after HF testing; and the integer i ranges from 1 to n, representing the index number of each small time interval $\tau$.

The pressure corresponding to each time interval $\tau$ is denoted by P(i). It is important to note that P(i) can be taken as the left boundary value of each interval due to the small pressure drop in a very small-time interval $\tau$. The C-function is defined as linearly proportional to the cumulative leak-off volume $V_L$, with A, $\Psi$, and $\tau$ considered as constants. Therefore, it characterizes the relative evolution trend of $V_L$ during the shut-in period, although with different dimensions. The expression for the C-function is:

$$C = \sum_{i=1}^{n}\left(\frac{P(i)-P_p}{\sqrt{i}}\right) \propto V_L; \tag{9}$$

where $\propto$ represents a proportional relationship.

As shown in FIG. 6, during the shut-in stage, the pump is closed and the testing system is kept sealed for a period, the fluid pressure will gradually decrease with the continuous leak-off, and the fracture walls will gradually close to the residual aperture level under the action of in-situ stress. The changes of P or V are caused completely by the fluid leak-off volume $V_L$ in this stage, thus the evolution of the total system stiffness $S_t$ can be directly and simply derived as:

$$S_t(2 \le i \le n) = \frac{dP}{dV} \approx \frac{dP}{dV_L} \propto \frac{dP}{dC} = \frac{\sqrt{i}\,[P(i)-P(i-1)]}{P(i)-P_p}. \tag{10}$$

As P(t) decreases, the difference between P(t) and $P_p$ gradually decreases. This causes $Q_L$ to decrease, indicating a smaller change rate of fluid leak-off or fracture volume. As the fracture approaches complete closure, the fracture volume change rate tends towards zero. Thereafter, the water volume $V_s$ of the testing system will dominate $S_t$, and $S_f$ will tend to infinity ($A_f dw_{fm}$ tends to zero). As a result, the dP/dC curve will tend to be horizontal, which is consistent with the analysis of the formula (3). Meanwhile, this implies that the influence of fluid leak-off on the total system stiffness is ignored after the fracture volume change rate tends to zero. The formula (3) also does not consider the compressibility of the fluid in the fracture. In other words, the main factor affecting the change of the total system stiffness is the fracture closure state, that is, the change of the fracture geometric size, or the fracture stiffness $S_f$, rather than the compressibility of the leak-off fluid itself.

As discussed above, the evolution trend of the total system stiffness during the pressure attenuation stage can be estimated based on the measured pressure-time data and the formula (10), and further be used to identify the fracture closure history and determine the upper and lower limits of the closure pressure. We expect to see two noticeable inflection points on the dP/dC vs. P curve (see FIG. 6), which respectively correspond to the fracture tip closure (stiffness begins to increase significantly) and complete closure (stiffness tend to stabilize). Note that the derivative dP/dC has a constant proportional relationship with the true stiffness value in the pressure attenuation stage. Therefore, it can be referred to as the converted stiffness. Under the premise of not affecting the stiffness curve evolution trend, it can also be scaled by a coefficient or some standardization algorithms.

Figure 10:
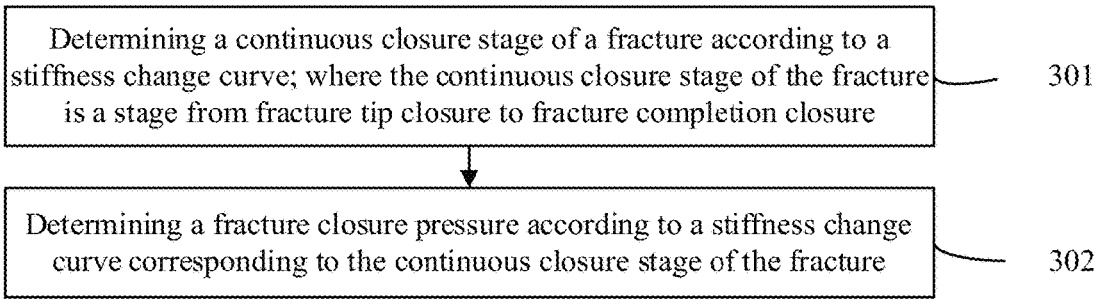
FIG. 10 illustrates a flowchart of a step 300 of the method for determining fracture closure pressure based on hydraulic fracturing according to an embodiment of the disclosure.

In some embodiments of the disclosure, as shown in FIG. 10, the step 300 of the method for determining fracture closure pressure based on hydraulic fracturing includes the following steps 301-302.

In step 301, a continuous closure stage of the fracture is determined according to the stiffness change curve; and the continuous closure stage of the fracture is a stage from fracture tip closure to fracture completion closure.

The whole testing process can be divided into three stages.

The stage I is from turning off the pump to closing the fracture tip. In the early stage of turning off the pump, due to system friction and fracture tip expansion (positive water hammer effect), the data in this stage shows obvious unstable fluctuations and oscillations, and as the fluid pressure decreases, the stiffness increases slowly.

The stage II is from the fracture tip closure to the fracture completion closure. The fracture stiffness increase faster, which directly leads to a rapid increase in the overall stiffness. Compared with the stage I, the process curve of this stage is more coherent and continuous, showing a monotonous rapid increase (the stage to be determined in the step 301).

The stage III is a stage after the fracture is closed. In this stage, the dP/dC curve is approximately horizontal, or increase evenly and slowly with the pressure drop, which means that the closure has been basically completed, the stiffness of the testing system is dominated by the water volume of the testing system, and the stiffness of the fracture tends to infinity.

In step 302, the fracture closure pressure is determined according to a stiffness change curve corresponding to the continuous closure stage of the fracture.

Figure 11:
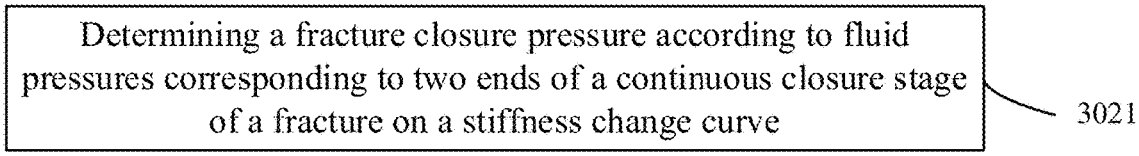
FIG. 11 illustrates a flowchart of a step 302 of the method for determining fracture closure pressure based on hydraulic fracturing according to an embodiment of the disclosure.
Figure 12:
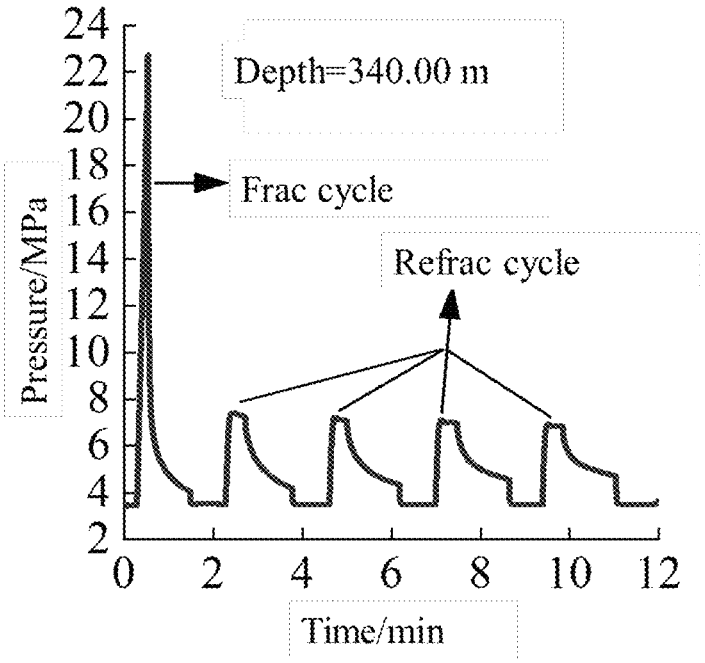
FIG. 12 illustrates a schematic diagram of a pressure-time curve with a depth of −340.00 meters (m) in a fourth refrac cycle according to an embodiment of the disclosure.
Figure 13:
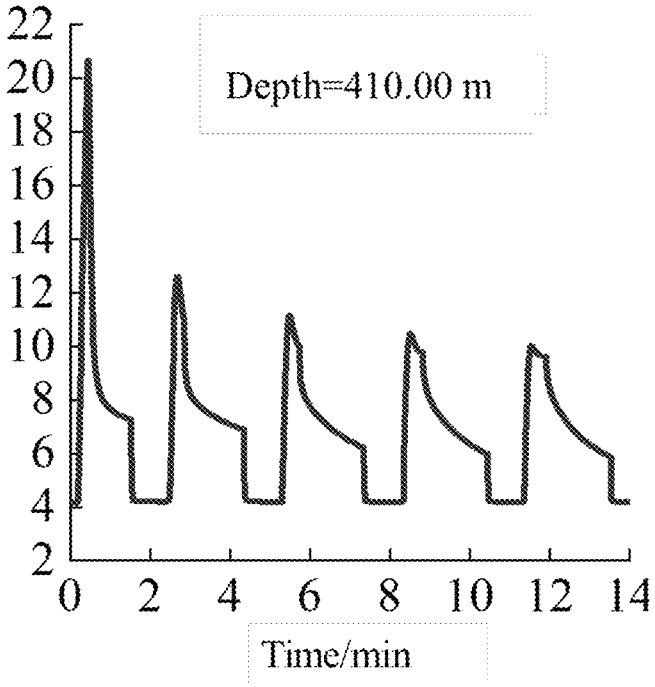
FIG. 13 illustrates a schematic diagram of a pressure-time curve with a depth of −410.00 m in the fourth refrac cycle according to an embodiment of the disclosure.
Figure 14:
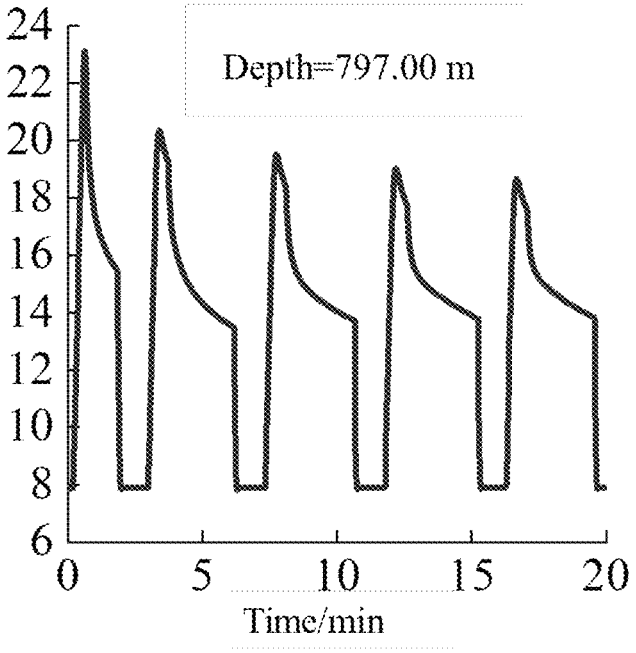
FIG. 14 illustrates a schematic diagram of a pressure-time curve with a depth of −797.00 m in the fourth refrac cycle according to an embodiment of the disclosure.
Figure 15:
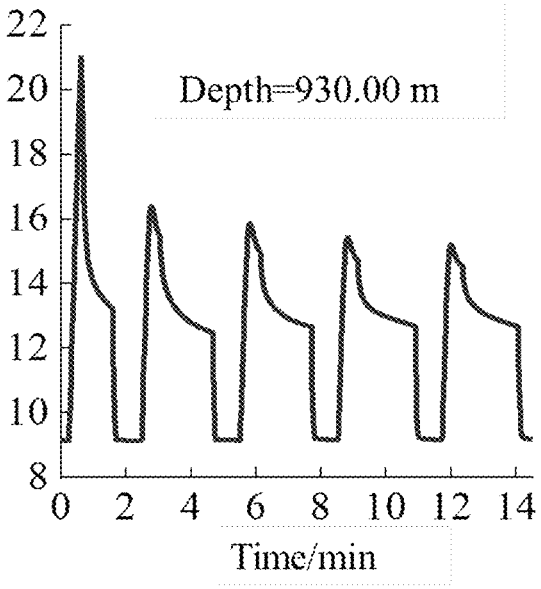
FIG. 15 illustrates a schematic diagram of a pressure-time curve with a depth of −930.00 m in the fourth refrac cycle according to an embodiment of the disclosure.
Figure 16:
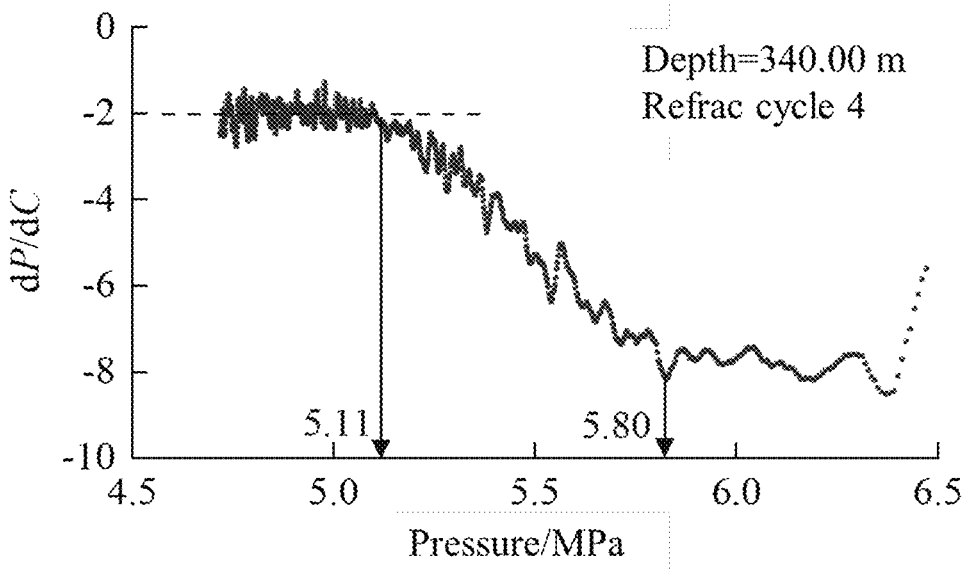
FIG. 16 illustrates a schematic diagram of an analysis result of a dP/dC method with a depth of −340.00 m in the fourth refrac cycle according to an embodiment of the disclosure.
Figure 17:
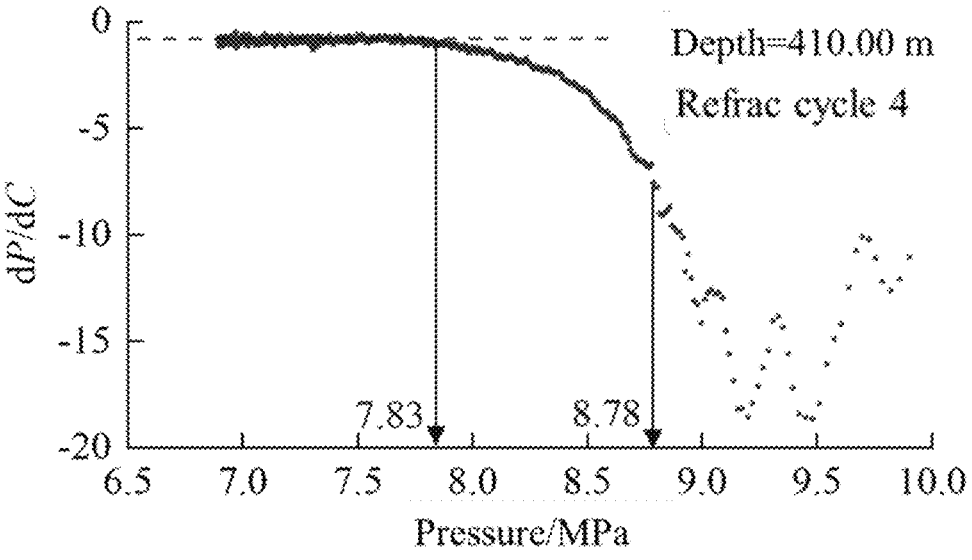
FIG. 17 illustrates a schematic diagram of an analysis result of the dP/dC method with a depth of −410.00 m in the fourth refrac cycle according to an embodiment of the disclosure.

In some embodiments of the disclosure, as shown in FIG. 11, the step 302 of the method for determining fracture closure pressure based on hydraulic fracturing includes the following step 3021.

In step 3021, the fracture closure pressure is determined according to fluid pressures corresponding to two ends of the continuous closure stage of the fracture on the stiffness change curve.

The fracture closure completion point (i.e., the closure pressure lower limit) is selected when the stiffness begins to stabilize, that is, when the curve is approximately horizontal, which can be determined by the tangent method. Therefore, the two inflection points picked by this method can simultaneously determine the upper and lower limits of the closure pressure, and a mean of the upper and lower limits of the closure pressure can determine the value of the minimum principal stress.

It can be seen from the above descriptions that the embodiments of the disclosure provide a method for determining fracture closure pressure based on hydraulic fracturing. Firstly, defects in the traditional closure pressure analysis method based on P–t data are discussed. Secondly, the corresponding relationship between the evolution of the stiffness of the testing system and the fracture closure state, as well as the cumulative leak-off volume of the fluid is analyzed. On this basis, for the HF testing curve, the constitutive equation for describing the cumulative leak-off volume of the fluid in the injection stage and the pressure attenuation stage is objectively derived under reasonable assumptions, thereby establishing the C function, and further proposing the dP/dC method for characterizing the stiffness evolution process of the testing system in the pressure attenuation stage.

In practice, based on the measured pressure-time data, combined with the formulas (8) and (10), a relationship curve of the dP/dC and P can be drawn, and the dP/dC curve in the pressure attenuation stage can intuitively reflect the real-time evolution trend of the stiffness $S_t$ of the testing system during the pressure drop process, and thus identifying the closure process of the fracture and determining the upper and lower limits of the closure pressure. It should be noted that since there is a constant proportional relationship between the derivative value dP/dC and the true stiffness value in the pressure attenuation stage (see the formulas (5) and (6)), it is called the reduced stiffness.

In a specific implementation method, the disclosure takes intact granite in Beishan, Gansu Province as an example to provide a specific implementation method of the method for determining fracture closure pressure based on hydraulic fracturing, which specifically includes the follows.

It can be understood that an important basis of the hydraulic fracturing measurement data calculation analysis is to analyze the pressure-time curve during the testing process. The existing methods commonly lack the quantitative characterization of the hydraulic coupling mechanism and change characteristics during the pressure attenuation process, and the characteristic response corresponding to the pressure drop curve before and after the fracture closure. Therefore, it is urgent to conduct in-depth research on the mechanical mechanism of the fracture closure process, to construct a method for determining the fracture closure pressure with a clear physical significance and objective effectiveness. Based on this, and to verify the effectiveness of the aforementioned dP/dC method, the specific implementation method of the disclosure takes the HF crustal stress test curves of the 340.00 m, 410.00 m, 797.00 m and 930.00 m testing sections in the complete granite borehole in Beishan, Gansu as an example, and uses this method to pick up the closure pressures of the above four testing sections respectively, and the pressure-time curves of each testing section are shown in FIGS. 11 to 14. Beishan, Gansu is the first pre-selected area for the high-level radioactive waste disposal repository. The site has a simple geological structure, flat terrain, and uniform and complete rock mass. These conditions are very close to the basic assumptions of the HF method. The high-quality measured data obtained provide an important guarantee for conducting case verification research on the dP/dC method.

Figure 18:
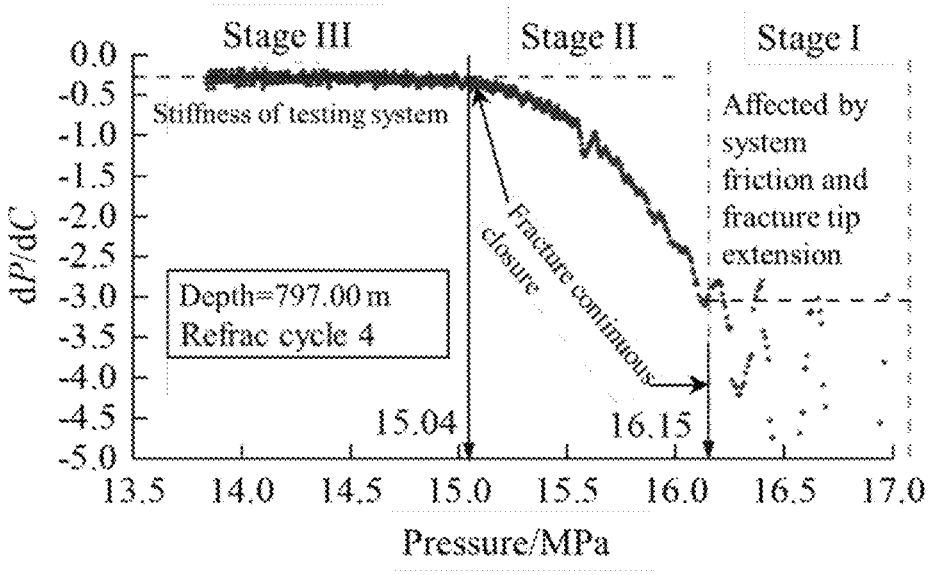
FIG. 18 illustrates a schematic diagram of an analysis result of the dP/dC method with a depth of −797.00 m in the fourth refrac cycle according to an embodiment of the disclosure.
Figure 19:
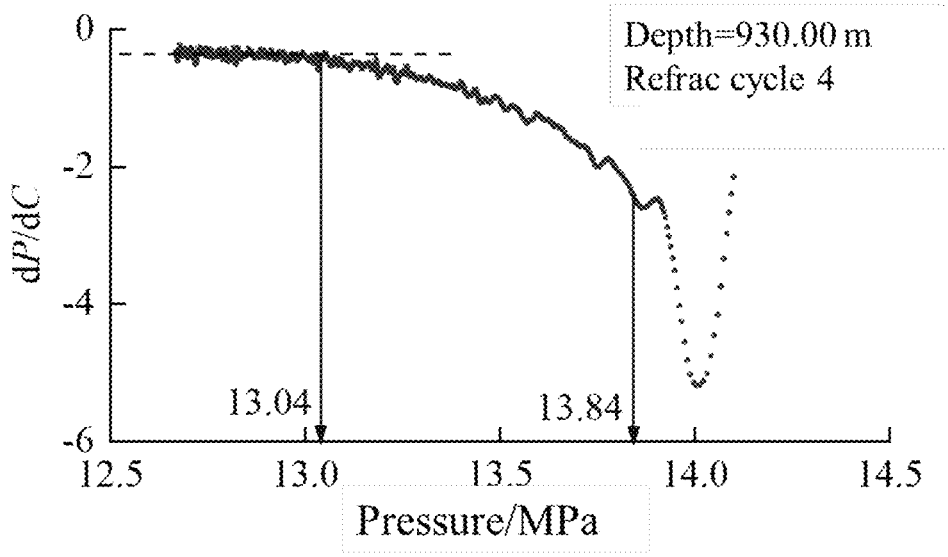
FIG. 19 illustrates a schematic diagram of an analysis result of the dP/dC method with a depth of −930.00 m in the fourth refrac cycle according to an embodiment of the disclosure.

FIGS. 15-18 give the analysis results of the dP/dC method in a fourth refrac cycle of each measured curve, and are marked in FIG. 18. The calculated time interval is unified from turning on the pump to releasing the pressure, and the data view is placed in the interval from turning off the pump to releasing the pressure, that is, the pressure attenuation stage, which can be referred to the text annotation in FIG. 7.

Continuing to refer to FIGS. 15 to 18, a horizontal axis of each of FIGS. 15 to 18 is pressure, and a vertical axis is dP/dC. In all the analysis results, the dP/dC method clearly shows the evolution of the stiffness of the testing system, and is basically consistent with the process expected by the relevant theoretical formula. As the fluid pressure decreases, the evolution of the stiffness $S_t$ of the testing system can be roughly divided into three stages, which are summarized as follows.

The stage I is from turning off the pump to closing the fracture tip. In the early stage of turning off the pump, due to system friction and fracture tip expansion (positive water hammer effect), the data in this stage shows obvious unstable fluctuations and oscillations, and as the fluid pressure decreases, the stiffness increases slowly.

The stage II is from the fracture tip closure to the fracture completion closure. The fracture stiffness increase faster, which directly leads to a rapid increase in the overall stiffness. Compared with the stage I, the process curve of this stage is more coherent and continuous, showing a monotonous rapid increase.

The stage III is a stage after the fracture is closed. In this stage, the dP/dC curve is approximately horizontal, or increase evenly and slowly with the pressure drop, which means that the closure has been basically completed, the stiffness of the testing system is dominated by the water volume of the testing system, and the stiffness of the fracture tends to infinity.

In summary, in the dP/dC method, the fracture start closing point (i.e., the closure pressure upper limit) is selected when the stiffness begins to continuously and significantly increase, but due to the influence of system friction and fracture tip expansion, the selection of this point may be subjective. The fracture closure completion point (i.e., the closure pressure lower limit) is selected when the stiffness begins to stabilize, that is, when the curve is approximately horizontal, which can be determined by the tangent method. Therefore, the two inflection points picked by this method can simultaneously determine the upper and lower limits of the closure pressure, and a mean of the upper and lower limits of the closure pressure can determine the value of the minimum principal stress.

It can be seen from the above descriptions that the embodiment of the disclosure proposes a new method, that is, the dP/dC method for accurately measuring the fracture closure pressure (i.e., the minimum principal stress) based on stiffness change characteristics aiming for the change characteristics of the pressure-time curve in the HF testing process and the influence factors thereof. The method can characterize the changing trend of the total system stiffness in the pressure attenuation stage based on the dP/dC curve and determine the upper and lower limits of the fracture closure pressure. The value points have clear physical definitions. The fracture start closing point (the upper limit of the closure pressure) is selected when the stiffness begins to increase significantly and continuously, and the fracture closure completion point (the lower limit of the closure pressure) is selected when the stiffness curve begins to stabilize. Their mean can be used to determine the minimum principal stress or the minimum horizontal principal stress of the measuring point.

Based on the same inventive concept, the embodiment of the disclosure further provides a device for determining fracture closure pressure based on hydraulic fracturing, which can be used to implement the method described in the above embodiments, such as the following embodiments. Since the principle of solving the problem by the device for determining fracture closure pressure based on hydraulic fracturing is similar to that of the method for determining fracture closure pressure based on hydraulic fracturing, the implementation of the device for determining fracture closure pressure based on hydraulic fracturing can be implemented with reference to the method for determining fracture closure pressure based on hydraulic fracturing, the repeated parts will not be repeated. The following used terms "unit" or "module" can be a combination of software and/or hardware that implements predetermined functions. Although the system described in the following embodiments is implemented in software, the implementation of hardware, or a combination of software and hardware, is also possible and conceived.

Figure 20:
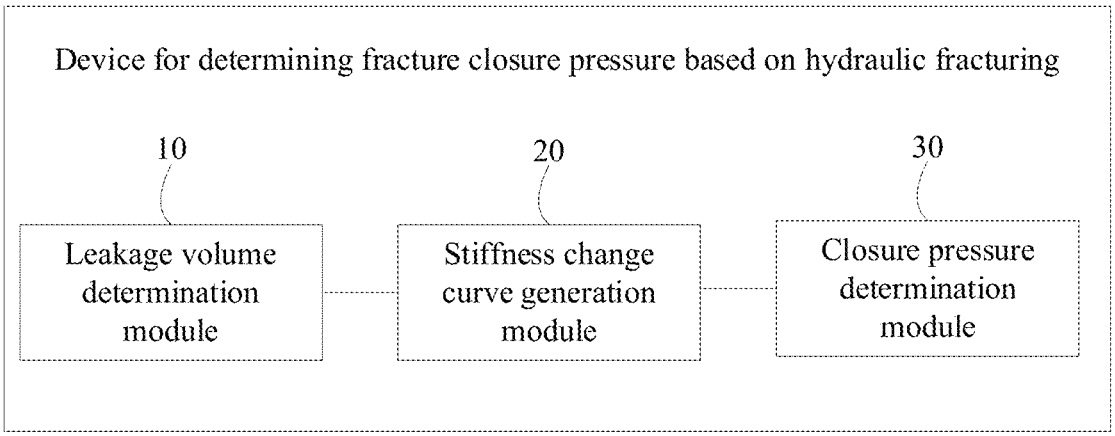
FIG. 20 illustrate a block diagram of a device for determining fracture closure pressure based on hydraulic fracturing according to an embodiment of the disclosure.

The embodiment of the disclosure provides a specific implementation of a device for determining fracture closure pressure based on hydraulic fracturing that can implement a method for determining fracture closure pressure based on hydraulic fracturing. Referring to FIG. 20, the device for determining fracture closure pressure based on hydraulic fracturing specifically includes a leak-off volume determination module 10, a stiffness change curve generation module 20 and a closure pressure determination module 30. The leak-off volume determination module 10 is configured to determine a leak-off volume of a fluid during a refrac cycle according to a fluid pressure during the refrac cycle. The stiffness change curve generation module 20 is configured to generate a stiffness change curve during the refrac cycle according to the leak-off volume of the fluid and the fluid pressure. The closure pressure determination module 30 is configured to determine the fracture closure pressure according to the stiffness change curve.

Figure 21:
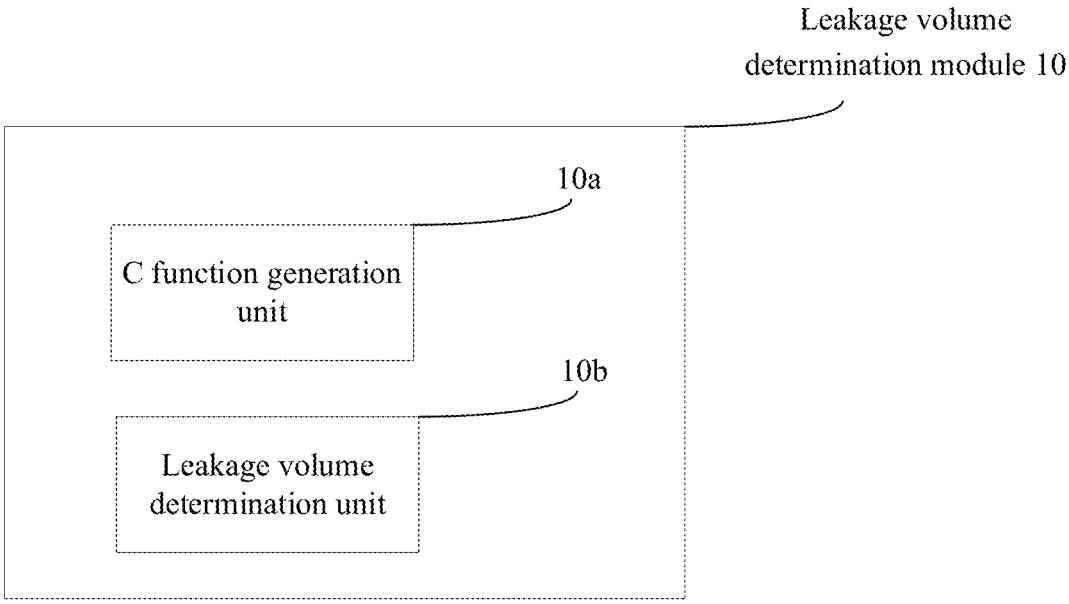
FIG. 21 illustrate a block diagram of a leak-off volume determination module 10 of the device for determining fracture closure pressure based on hydraulic fracturing according to an embodiment of the disclosure.

In some embodiments of the disclosure, the leak-off volume is a cumulative leak-off volume during the refrac cycle. As shown in FIG. 21, the leak-off volume determination module 10 includes a C function generation unit 10*a* and a leak-off volume determination unit 10*b*. The C function generation unit 10*a* is configured to generate a C function according to a pressure curve corresponding to the fluid pressure; and the C function has a linear relationship with the cumulative leak-off volume of the fluid. The leak-off volume determination unit 10*b* is configured to determine the cumulative leak-off volume of the fluid according to the C function.

Figure 22:
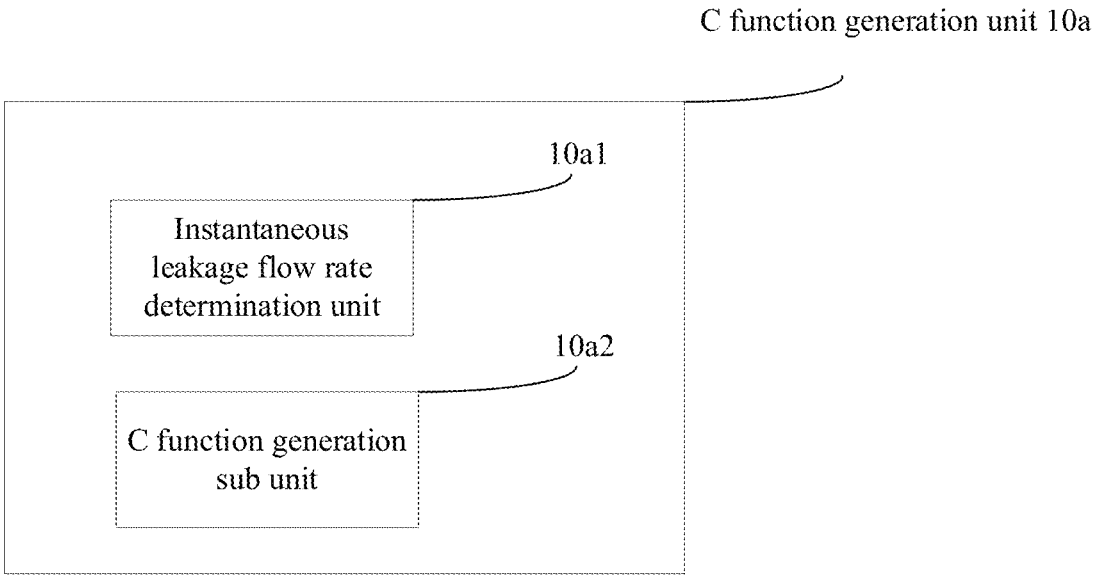
FIG. 22 illustrate a block diagram of a C function generation unit 10*a* of the device for determining fracture closure pressure based on hydraulic fracturing according to an embodiment of the disclosure.

In some embodiments of the disclosure, as shown in FIG. 22, the C function generation unit 10*a* includes an instantaneous leak-off flow rate determination unit 10*a*1 and a C function generation sub unit 10*a*2. The instantaneous leak-off flow rate determination unit 10*a*1 is configured to determine the instantaneous leak-off flow rate of the fluid during the refrac cycle according to the Carter leak-off model and the pressure curve. The C function generation sub unit 10*a*2 is configured to generate the C function according to the instantaneous leak-off flow rate.

Figure 23:
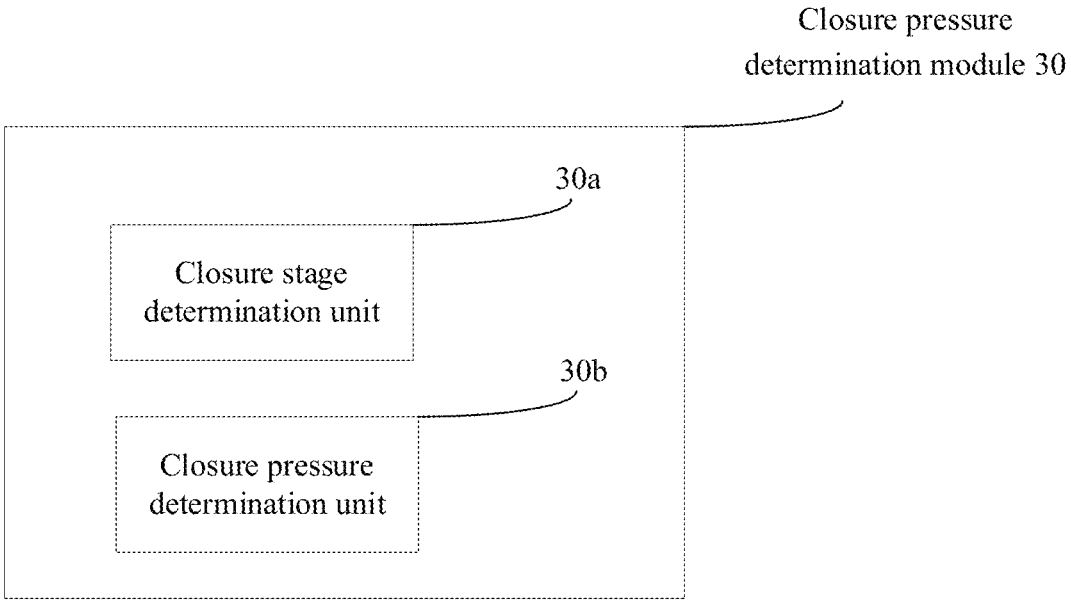
FIG. 23 illustrate a block diagram of a closure pressure determination module 30 of the device for determining fracture closure pressure based on hydraulic fracturing according to an embodiment of the disclosure.

In some embodiments of the disclosure, as shown in FIG. 23, the closure pressure determination module 30 includes a closure stage determination unit 30*a* and a closure pressure determination unit 30*b*. The closure stage determination unit 30*a* is configured to determine a continuous closure stage of the fracture according to the stiffness change curve; and the continuous closure stage of the fracture is a stage from fracture tip closure to fracture completion closure. The closure pressure determination unit 30*b* is configured to determine the fracture closure pressure according to a stiffness change curve corresponding to the continuous closure stage of the fracture.

Figure 24:
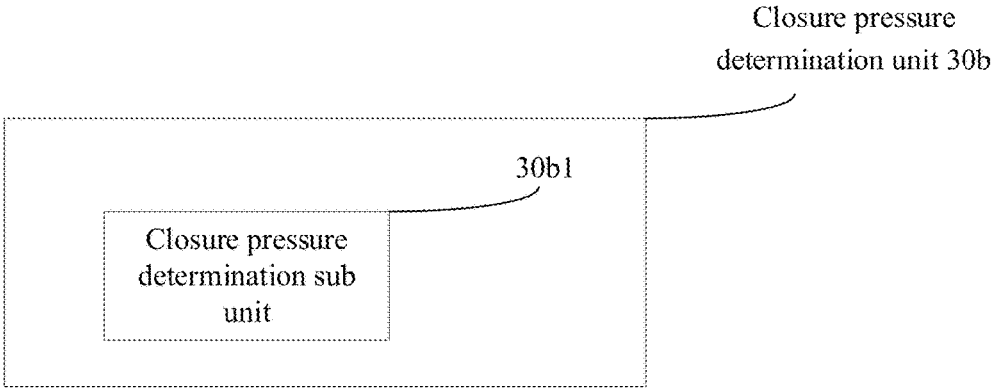
FIG. 24 illustrate a block diagram of a closure pressure determination unit 30*b* of the device for determining fracture closure pressure based on hydraulic fracturing according to an embodiment of the disclosure.

In some embodiments of the disclosure, as shown in FIG. 24, the closure pressure determination unit 30*b* includes a closure pressure determination sub unit 30*bl*. The closure pressure determination sub unit is configured to determine the fracture closure pressure according to fluid pressures corresponding to two ends of the continuous closure stage of the fracture on the stiffness change curve.

It can be seen from the above descriptions that the embodiments of the disclosure provide a device for determining fracture closure pressure based on hydraulic fracturing, and the device includes the leak-off volume determination module, the stiffness change curve generation module and the closure pressure determination module. The leak-off volume determination module is configured to determine the leak-off volume of the fluid during the refrac cycle according to the fluid pressure during the refrac cycle. The stiffness change curve generation module is configured to generate the stiffness change curve during the refrac cycle according to the leak-off volume of the fluid and the fluid pressure. The closure pressure determination module is configured to determine the fracture closure pressure according to the stiffness change curve.

The disclosure quantitatively characterizes a hydraulic coupling mechanism and change characteristics during a pressure attenuation process, and accurately describes characteristic response corresponding to a pressure drop curve before and after the fracture closure, thereby providing a device for determining fracture closure pressure with clear physical significance and objective effectiveness.

Figure 25:
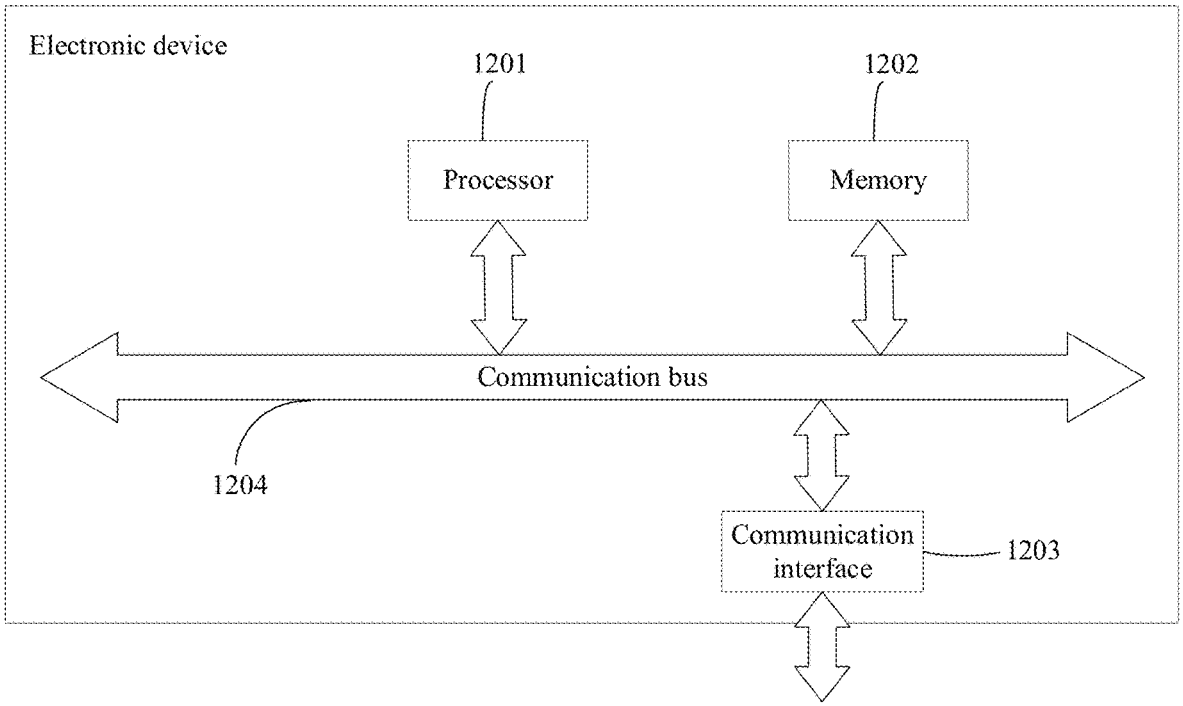
FIG. 25 illustrate a schematic structural diagram of an electronic device according to an embodiment of the disclosure.

The embodiments of the disclosure also provide a specific implementation of an electronic device capable of implementing all steps in the method for determining fracture closure pressure based on hydraulic fracturing in the above embodiments. As shown in FIG. 25, the electronic device specifically includes a processor 1201, a memory 1202, a communication interface 1203 and a bus 1204.

Specifically, the processor 1201, the memory 1202 and the communication interface 1203 are communicated with each other through the bus 1204. The communication interface 1203 is configured to implement information transmission between a server device and a client device.

The processor 1201 is configured to call a computer program in the memory 1202, and the computer program is configured to be executed by the processor 1201 to implement the steps of the method for determining fracture closure pressure based on hydraulic fracturing in the above embodiments, for example, the computer program is configured to be executed by the processor 1201 to implement the following steps 100-300.

In step 100, a leak-off volume of a fluid during a refrac cycle is determined according to a fluid pressure during the refrac cycle.

In step 200, a stiffness change curve during the refrac cycle is generated according to the leak-off volume of the fluid and the fluid pressure.

In step 300, the fracture closure pressure is determined according to the stiffness change curve.

The embodiments of the disclosure further provide a non-transitory computer-readable storage medium that can implement the steps of the method for determining fracture closure pressure based on hydraulic fracturing in the above embodiments. The non-transitory computer-readable storage medium stores the computer program therein, and the computer program is configured to be executed by the processor to implement the steps of the method for determining fracture closure pressure based on hydraulic fracturing in the above embodiments, for example, the computer program is configured to be executed by the processor 1201 to implement the following steps 100-300.

In step 100, a leak-off volume of a fluid during a refrac cycle is determined according to a fluid pressure during the refrac cycle.

In step 200, a stiffness change curve during the refrac cycle is generated according to the leak-off volume of the fluid and the fluid pressure.

In step 300, the fracture closure pressure is determined according to the stiffness change curve.

Each embodiment in the disclosure is described in a progressive manner, and the same or similar parts between the embodiments can be referred to each other, and each embodiment focuses on the differences from other embodiments. In particular, for the hardware and program embodiment, since it is basically similar to the method embodiment, the description is relatively simple, and the relevant parts can be referred to the partial description of the method embodiment.

The above is a description of a specific embodiment of the disclosure. Other embodiments are within the scope of the appended claims. In some cases, the actions or steps recorded in the claims can be performed in an order different from that in the embodiments and still achieve the desired results. In addition, the processes depicted in the drawings do not necessarily require the specific order or continuous order shown to achieve the desired results. In some embodiments, multitasking and parallel processing are also possible or may be advantageous.

Although the disclosure provides method operation steps such as embodiments or flowcharts, more or fewer operation steps may be included based on conventional or non-creative work. The order of steps listed in the embodiments is only one way of executing the order of many steps and does not represent the only execution order. When the actual device or client product is executed, it can be executed in the order of the method shown in the embodiments or the drawings or in parallel (for example, in a parallel processor or multi-threaded processing environment).

For the convenience of description, the above devices are described in terms of functions and are divided into various modules. Of course, when implementing the embodiments of this specification, the functions of each module can be implemented in the same or more software and/or hardware, or the modules that implement the same function can be implemented by a combination of multiple sub-modules or sub-units. The device embodiments described above are only schematic. For example, the division of the units is only a logical function division. There may be other division methods in actual implementation. For example, multiple units or components can be combined or integrated into another system, or some features can be ignored or not executed. Another point is that the mutual coupling, direct coupling or communication connection shown or discussed can be through some interfaces, indirect coupling or communication connection of devices or units, which can be electrical, mechanical or other forms.

Those skilled in the art also know that, in addition to implementing the controller in a purely computer-readable program code, the controller can be made to implement the same function in the form of logic gates, switches, application-specific integrated circuits, programmable logic controllers, and embedded microcontrollers by logically programming the method steps. Therefore, such a controller can be considered as a hardware component, and the devices for implementing various functions included therein can also be considered as structures within the hardware component. Or even, the devices for implementing various functions can be considered as both software modules for implementing the method and structures within the hardware component.

In a typical configuration, a computing device includes one or more processors (CPU), input/output interfaces, network interfaces, and memory.

The memory may include non-permanent storage in a computer-readable medium, random access memory (RAM) and/or non-transitory memory in the form of read-only memory (ROM) or flash RAM. The memory is an example of the computer-readable medium.

Each embodiment in this specification is described in a progressive manner, and the same and similar parts between the embodiments can be referred to each other, and each embodiment focuses on the differences from other embodiments. In particular, for the system embodiment, since it is basically similar to the method embodiment, the description is relatively simple, and the relevant parts can be referred to the partial description of the method embodiment. In the description of this specification, the description of the reference terms "an embodiment", "some embodiments", "example", "specific example", or "some examples" means that the specific features, structures, materials or characteristics described in conjunction with the embodiment or example are included in at least one embodiment or example of this specification. In this specification, the schematic representation of the above terms does not necessarily target the same embodiment or example. Moreover, the specific features, structures, materials or characteristics described can be combined in any one or more embodiments or examples in a suitable manner. In addition, in the absence of contradiction, those skilled in the art can combine the different embodiments or examples described in this specification and the features of the different embodiments or examples.

The above is only an example of the embodiment of the disclosure and is not intended to limit the embodiment of the disclosure. For those skilled in the art, the embodiment of the disclosure may have various changes and variations. Any modification, equivalent replacement and improvement made within the spirit and principle of the embodiment of the disclosure shall be included in the scope of the claims of the embodiment of the disclosure.

What is claimed is:

1. A method for determining fracture closure pressure based on hydraulic fracturing, comprising:

determining a leak-off volume of a fluid during a refrac cycle according to a fluid pressure during the refrac cycle;

generating a stiffness change curve during the refrac cycle according to the leak-off volume of the fluid and the fluid pressure; and determining the fracture closure pressure according to the stiffness change curve;

wherein the determining a leak-off volume of a fluid during a refrac cycle according to a fluid pressure during the refrac cycle comprises:

generating a C function according to a pressure curve corresponding to the fluid pressure; wherein the C function has a linear relationship with a cumulative leak-off volume of the fluid; and determining the cumulative leak-off volume of the fluid according to the C function; wherein the C function is expressed as follows:

$$C(\Delta t) = \int_0^{\Delta t} \sqrt{\Delta t - \tau}\, d(P(\tau)) \propto V_L; \tag{1}$$

wherein P represents a measured pressure of the fluid, t represents a time, $\tau$ represents any intermediate moment within a time interval $\Delta t$, and $V_L$ represents the cumulative leak-off volume of the fluid;

wherein the determining the fracture closure pressure according to the stiffness change curve comprises:

determining a continuous closure stage of a fracture according to the stiffness change curve; wherein the continuous closure stage of the fracture is a stage from fracture tip closure to fracture completion closure; and determining the fracture closure pressure according to a stiffness change curve corresponding to the continuous closure stage of the fracture;

wherein the generating a stiffness change curve during the refrac cycle according to the leak-off volume of the fluid and the fluid pressure comprises:

a change of the measured pressure P being directly related to a change of a fluid volume V in a testing system and the fracture, and being not related to the time t; and preforming a chain decomposition on dP/dt as follows:

$$\frac{dP}{dt} = \frac{dP}{dV}\frac{dV}{dt} = \begin{Bmatrix} S_t\frac{dV_I - dV_L}{dt} \\ -S_t\frac{dV_L}{dt} \end{Bmatrix} = \begin{Bmatrix} S_t(Q_I - Q_L) \\ -S_tQ_L \end{Bmatrix} \approx \begin{Bmatrix} S_tQ_I & \text{injection stage} \\ -S_tQ_L & \text{pressure attenuation stage} \end{Bmatrix}; \quad (2)$$

representing a stiffness $S_t$ of the testing system by using compliance form superposition as follows:

$$S_t = \frac{dP}{dV} = \frac{1}{C_t} = \frac{1}{\frac{1}{S_f} + \frac{1}{S_s}} \approx \frac{1}{\frac{dV_f}{dP} + V_sc_w} = \frac{1}{\frac{A_f dw_{fm}}{dP} + V_sc_w}; \quad (3)$$

wherein $C_t$ represents a total system compliance; $A_f$ represents a total area of the fracture, and $V_f$ represents a total volume of the fracture; and $V_s$ represents a volume of a fracturing section and a drill pipe;

wherein a total seepage area A is composed of the total area of the fracture and a side area of the fracturing section, and the total seepage area A is expressed as follows:

$$A = A_f + \pi dh_t \quad (4);$$

wherein $h_t$ represents a length of the fracturing section, d represents a diameter of a borehole, the total seepage area A is considered a constant during the refrac cycle, so that an instantaneous leak-off flow rate $Q_L$ of the fluid occurred by the total area of the fracture and the side area of the fracturing section is derived based on a Carter leak-off model as follows:

$$Q_L = \frac{A(P - P_p)\sqrt{\frac{\phi c_t k}{\pi\mu}}}{\sqrt{t - t_0}} = \frac{A\Psi(P - P_0)}{\sqrt{t - t_0}}; \quad (5)$$

wherein $t-t_0$ represents a duration of fluid infiltration; a square root at a numerator position contains some inherent parameters related to geological rock mass, and an overall of the square root at the numerator position is recorded as a constant $\Psi$; and $P_p$ represents a pore pressure in rock mass of a testing section and is considered as a constant;

integrating the formula (5) within the time interval $\Delta t$ to obtain the cumulative leak-off volume $V_L$ of the fluid from beginning of injection as follows:

$$V_L(\Delta t) = A\Psi\int_0^{\Delta t}\frac{(P(\tau) - P_p)}{\sqrt{\Delta t - \tau}}d\tau = -2A\Psi\int_0^{\Delta t}(P(\tau) - P_p)d\sqrt{\Delta t - \tau} = \quad (6)$$

-continued $$-2A\Psi\int_0^{\Delta t}\left[\left(P(\tau) - P_p\sqrt{\Delta t - \tau}\,\Big|_0^{\Delta t} - \int_0^{\Delta t}\sqrt{\Delta t - \tau}\,d(P(\tau))\right)\right] = 2A\Psi\int_0^{\Delta t}\sqrt{\Delta t - \tau}\,d(P(\tau)) = 2A\Psi C(\Delta t);$$

wherein a time lower limit value of 0 corresponds to an injection start moment in the refrac cycle, and $P(0) = P_p$; and C represents the C function;

expanding the formula (1) into a discrete form by superimposing a summation formula when the measured pressure P and the time interval $\Delta t$ are known; wherein the discrete form of the C function is expressed as follows:

$$C(\Delta t_n) \approx \sum_{i=1}^{n}(P_i - P_{i-1})\sqrt{\Delta t_n - \Delta t_i}; \quad (7)$$

wherein a subscript n represents a number of a point for measuring pressure, the time interval $\Delta t$ corresponding to the pressure curve is divided into n equal parts, and a pressure value in each of the n equal parts is constant;

calculating the cumulative leak-off volume $V_L$ of the fluid from beginning of injection according to measured pressure-time data as follows:

$$V_L(\Delta t_n) \approx 2A\Psi C(\Delta t_n) \quad (8);$$

deriving an evolution law of the stiffness $S_t$ of the testing system directly as follows:

$$S_t = \frac{dP}{dV} \approx \frac{dP}{dV_L} \propto \frac{dP}{dC}. \quad (9)$$

2. The method for determining fracture closure pressure as claimed in claim 1, wherein the leak-off volume is the cumulative leak-off volume during the refrac cycle.

3. The method for determining fracture closure pressure as claimed in claim 2, wherein the generating a C function according to a pressure curve corresponding to the fluid pressure comprises:

determining the instantaneous leak-off flow rate of the fluid during the refrac cycle according to the Carter leak-off model and the pressure curve; and generating the C function according to the instantaneous leak-off flow rate of the fluid.

4. The method for determining fracture closure pressure as claimed in claim 1, wherein the determining the fracture closure pressure according to a stiffness change curve corresponding to the continuous closure stage of the fracture comprises:

determining the fracture closure pressure according to fluid pressures corresponding to two ends of the continuous closure stage of the fracture on the stiffness change curve.

5. A device for determining fracture closure pressure based on hydraulic fracturing, comprising:

a leak-off volume determination module, configured to determine a leak-off volume of a fluid during a refrac cycle according to a fluid pressure during the refrac cycle;

a stiffness change curve generation module, configured to generate a stiffness change curve during the refrac cycle according to the leak-off volume of the fluid and the fluid pressure; and a closure pressure determination module, configured to determine the fracture closure pressure according to the stiffness change curve;

wherein the leak-off volume determination module comprises:

a C function generation unit, configured to generate a C function according to a pressure curve corresponding to the fluid pressure; wherein the C function has a linear relationship with a cumulative leak-off volume of the fluid; and a leak-off volume determination unit, configured to determine the cumulative leak-off volume of the fluid according to the C function;

wherein the C function is expressed as follows:

$$C(\Delta t) = \int_0^{\Delta t} \sqrt{\Delta t - \tau}\, d(P(\tau)) \propto V_L;$$

wherein P represents a measured pressure of the fluid, t represents a time, $\tau$ represents any intermediate moment within a time interval $\Delta t$, and $V_L$ represents the cumulative leak-off volume of the fluid;

wherein the closure pressure determination module comprises:

a closure stage determination unit, configured to determine a continuous closure stage of a fracture according to the stiffness change curve; wherein the continuous closure stage of the fracture is a stage from fracture tip closure to fracture completion closure; and a closure pressure determination unit, configured to determine the fracture closure pressure according to a stiffness change curve corresponding to the continuous closure stage of the fracture;

wherein the stiffness change curve generation module is specifically configured to that a change of the measured pressure P is directly related to a change of a fluid volume V in a testing system and the fracture, and is not related to the time t; and the stiffness change curve generation module is configured to perform a chain decomposition on dP/dt as follows:

$$\frac{dP}{dt} = \frac{dP}{dV}\frac{dV}{dt} = \begin{Bmatrix} S_t \dfrac{dV_I - dV_L}{dt} \\ -S_t \dfrac{dV_L}{dt} \end{Bmatrix} = \begin{Bmatrix} S_t(Q_I - Q_L) \\ -S_t Q_L \end{Bmatrix} \approx \begin{Bmatrix} S_t Q_I & \text{injection stage} \\ -S_t Q_L & \text{pressure attenuation stage} \end{Bmatrix}; \quad (2)$$

represent a stiffness $S_t$ of the testing system by using compliance form superposition as follows:

$$S_t = \frac{dP}{dV} = \frac{1}{C_t} = \frac{1}{\frac{1}{S_f} + \frac{1}{S_s}} \approx \frac{1}{\frac{dV_f}{dP} + V_s c_w} = \frac{1}{\frac{A_f dw_{fm}}{dP} + V_s c_w}; \quad (3)$$

wherein $C_t$ represents a total system compliance; $A_f$ represents a total area of the fracture, and $V_f$ represents a total volume of the fracture; and $V_s$ represents a volume of a fracturing section and a drill pipe;

wherein a total seepage area A is composed of the total area of the fracture and a side area of the fracturing section, and the total seepage area A is expressed as follows:

$$A = A_f + \pi d h_t \quad (4);$$

wherein $h_t$ represents a length of the fracturing section, d represents a diameter of a borehole, the total seepage area A is considered a constant during the refrac cycle, so that an instantaneous fluid leak-off flow rate $Q_L$ occurred by the total area of the fracture and the side area of the fracturing section is derived based on a Carter leak-off model as follows:

$$Q_L = \frac{A(P - P_p)\sqrt{\frac{\phi c_t k}{\pi \mu}}}{\sqrt{t - t_0}} = \frac{A\Psi(P - P_0)}{\sqrt{t - t_0}}; \quad (5)$$

wherein $t - t_0$ represents a duration of fluid infiltration; a square root at a numerator position contains some inherent parameters related to geological rock mass, and an overall of the square root at the numerator position is recorded as a constant $\Psi$; and $P_p$ represents a pore pressure in rock mass of a testing section, and is considered as a constant;

integrate the formula (5) within the time interval $\Delta t$ to obtain the cumulative leak-off volume $V_L$ of the fluid from beginning of injection as follows:

$$V_L(\Delta t) = A\Psi \int_0^{\Delta t} \frac{(P(\tau) - P_p)}{\sqrt{\Delta t - \tau}} d\tau = -2A\Psi \int_0^{\Delta t} (P(\tau) - P_p) d\sqrt{\Delta t - \tau} = -2A\Psi \int_0^{\Delta t} \left[ \left( P(\tau) - P_p \sqrt{\Delta t - \tau} \,\Big|_0^{\Delta t} - \int_0^{\Delta t} \sqrt{\Delta t - \tau}\, d(P(\tau)) \right) \right] = 2A\Psi \int_0^{\Delta t} \sqrt{\Delta t - \tau}\, d(P(\tau)) = 2A\Psi C(\Delta t); \quad (6)$$

wherein a time lower limit value of 0 corresponds to an injection start time in the refrac cycle, and $P(0) = P_p$; and C represents the C function;

expand the formula (1) into a discrete form by superimposing a summation formula when the measured pressure P and the time interval $\Delta t$ are known; wherein the discrete form of the C function is expressed as follows:

$$C(\Delta t_n) \approx \sum_{i=1}^{n} (P_i - P_{i-1}) \sqrt{\Delta t_n - \Delta t_i}; \quad (7)$$

wherein a subscript n represents a number of a point for measuring pressure, the time interval $\Delta t$ corresponding to the pressure curve is divided into n equal parts, and a pressure value in each of the n equal parts is constant;

calculate the cumulative leak-off volume $V_L$ of the fluid from beginning of injection according to measured pressure-time data as follows:

$$V_L(\Delta t_n) \approx 2A\Psi C(\Delta t_n); \quad (8)$$

derive an evolution law of the stiffness $S_t$ of the testing system directly as follows:

$$S_t = \frac{dP}{dV} \approx \frac{dP}{dV_L} \propto \frac{dP}{dC}. \quad (9)$$

6. The device for determining fracture closure pressure as claimed in claim 5, wherein the leak-off volume is the cumulative leak-off volume during the refrac cycle.

7. The device for determining fracture closure pressure as claimed in claim 6, wherein the C function generation unit comprises:

an instantaneous leak-off flow rate determination unit, configured to determine the instantaneous leak-off flow rate of the fluid during the refrac cycle according to the Carter leak-off model and the pressure curve; and a C function generation sub unit, configured to generate the C function according to the instantaneous leak-off flow rate of the fluid; and wherein the closure pressure determination unit comprises:

a closure pressure determination sub unit, configured to determine the fracture closure pressure according to fluid pressures corresponding to two ends of the continuous closure stage of the fracture on the stiffness change curve.

8. An electronic device, comprising a memory, a processor, and a computer program stored in the memory and executed in the processor, wherein the computer program is configured to be executed by the processor to implement the steps of the method for determining fracture closure pressure based on hydraulic fracturing as claimed in claim 1.

9. A computer-readable storage medium having a computer program stored therein, wherein the computer program is configured to be executed by a processor to implement the steps of the method for determining fracture closure pressure based on hydraulic fracturing as claimed in claim 1.

* * * * *